US005155006A

United States Patent [19]

Goto et al.

[11] Patent Number: 5,155,006

[45] Date of Patent: Oct. 13, 1992

[54] SILVER HALIDE PHOTOGRAPHIC MATERIAL

[75] Inventors: Takahiro Goto; Kazunobu Katoh, both of Kanagawa, Japan

[73] Assignee: Fuji Photo Film Co., Ltd., Kanagawa, Japan

[21] Appl. No.: 584,668

[22] Filed: Sep. 19, 1990

[30] Foreign Application Priority Data

Sep. 19, 1989 [JP] Japan ..... 1-242442

[51] Int. Cl.[5] ..... G03C 1/06; G03C 1/42; G03C 5/26

[52] U.S. Cl. ..... 430/264; 430/223; 430/566; 430/598; 430/957

[58] Field of Search ..... 430/264, 223, 957, 598, 430/566

[56] References Cited

U.S. PATENT DOCUMENTS 4,619,884 10/1986 Singer ..... 430/957
4,684,604 8/1987 Harder ..... 430/223
4,770,990 9/1988 Nakamura et al. ..... 430/223

*Primary Examiner*—Richard L. Schilling
*Attorney, Agent, or Firm*—Sughrue, Mion, Zinn, Macpeak & Seas

[57] ABSTRACT

A silver halide photographic material comprising;

a support; at least one light-sensitive silver halide emulsion layer containing a hydrazine derivative on the support; at least one hydrophilic colloid layer containing a redox compound capable of releasing a development inhibitor upon oxidation; and a developing agent incorporated, at least, into the at least one light-sensitive silver halide emulsion layer or the at least one hydrophilic colloid layer and a method for forming an image which comprises the steps of imagewise exposing to light the silver halide photographic material described above; and developing the exposed material with a developing solution having a sulfite ion concentration of at least about 0.15 mol/l and a pH of from about 10.5 to about 12.3.

20 Claims, 1 Drawing Sheet

FIGURE (a)
FIGURE (b)
FIGURE (c)
FIGURE (d)
FIGURE (e)
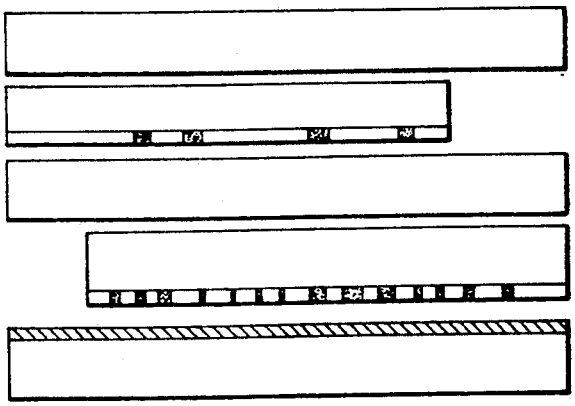

SILVER HALIDE PHOTOGRAPHIC MATERIAL

FIELD OF THE INVENTION

The present invention relates to a silver halide photographic material and a method of forming an ultra-high contrast negative image using this material. More particularly, the present invention relates to an ultrahigh contrast negative type silver halide photographic material suitable for use in the field of photomechanical printing processes.

BACKGROUND OF THE INVENTION

The field of photomechanical processes requires photographic light-sensitive materials that give satisfactory image reproduction of originals and use stable processing solutions that are easily replenished in order to cope with the diverse and complex materials that must be printed. The diverse originals in line work, for example, are photo-composed letters, handwritten letters, illustrations, and dot prints, all of which contain images of different densities and line widths.

There has been great demand for a process camera, a photographic light-sensitive material or an image formation system that will provide excellent reproduction of the original. In the photomechanical processing of catalogues or large posters, on the other hand, enlargement or reduction of a dot print is primarily used. When a dot print is enlarged in plate making, the line number per inch is reduced and the dots blurred. When a dot print is reduced, the line number per inch increases and the dots become finer than the original. Accordingly, an image formation system having a broader latitude than presently known that would maintain the reproducibility of halftone gradation is also desired.

A halogen lamp or a xenon lamp is commonly used as the light source for a process camera. In order to obtain photographic sensitivity to these light sources, photographic materials are usually subjected to orthochromatic sensitization. However, orthochromatic photographic materials are more susceptible to the effects of lens chromatic aberration and thus the image quality is more likely to deteriorate. This deterioration is most conspicuous when using a xenon lamp.

Known systems meet the demand for broad latitude. For example, one such method involves processing a lith type silver halide light-sensitive material containing silver chlorobromide (containing at least 50% silver chloride) with hydroquinone developing solution having an extremely low effective sulfite ion concentration (usually 0.1 mol/l or less) to obtain a line or dot image having high contrast and high density in which image areas and non-image areas are clearly distinguished. However, the developer used with this method is extremely sensitive to air oxidation due to the low sulfite concentration. This necessitates various efforts and devices to stabilize the developer which result in a reduction of the processing speed and a reduction in working efficiency.

Such problems have created a demand for an image formation system which eliminates the image formation instability associated with the above-described lith development system and provides an ultrahigh contrast image by using a processing solution having satisfactory preservation stability. One solution that was proposed is to process a surface latent image type silver halide photographic material containing a specific acylhydrazine compound with a developing solution having a pH between 11.0 and 12.3 and containing at least 0.15 mol/l of a sulfite preservative. Such a process has developer with satisfactory stability and forms an ultrahigh contrast negative image having a gamma exceeding 10 (see, U.S. Pat. Nos. 4,166,742, 4,168,977, 4,221,857, 4,224,401, 4,243,739, 4,272,606, and 4,311,781). Such an image formation system can also use silver iodobromide and silver chloroiodobromide as well as silver chlorobromide. In contrast, more conventional ultrahigh contrast image formation systems can only use photographic materials of silver chlorobromide having high silver chloride content.

The above-described image formation system exhibits excellent performance in dot quality, stability of processing, rapidness of processing, and reproducibility of originals. However, a system that provides still further improvement in reproducibility of originals is desired in order to cope with the present diversity of originals to be printed.

An attempt to broaden the area of gradation that could be reproduced was made using a photographic light-sensitive material containing a redox compound capable of releasing a photographically useful group upon oxidation (see, JP-A-61-213847 (the term "JP-A" as used herein means an "unexamined published Japanese patent application") and U.S. Pat. No. 4,684,604). However, if an ultrahigh contrast image formation system using a hydrazine derivative is combined with these redox compounds, the redox compounds disrupt the high contrast effect.

SUMMARY OF THE INVENTION

An object of the present invention is to provide a light-sensitive material for plate making which provides a high contrast image using a very stable developing solution.

Another object of the present invention is to provide a light-sensitive material for plate making which has broad halftone gradation.

A further object of the present invention is to provide a light-sensitive material for plate making which uses a hydrazine nucleating agent and has high contrast and broad halftone gradation.

These and other objects of the present invention are satisfied by a silver halide photographic material comprising a support; at least one light-sensitive silver halide emulsion layer containing a hydrazine derivative on said support; at least one hydrophilic colloid layer other than the light-sensitive silver halide emulsion layer, containing a redox compound capable of releasing a development inhibitor upon oxidation, a developing agent incorporated, at least, into said at least one silver halide emulsion layer or said at least one hydrophilic colloid layer.

BRIEF DESCRIPTION OF THE DRAWINGS

FIG. 1 is a schematic illustration of a configuration of basic elements for forming superimposed letter images through a contact process when exposed to light. (a) represents a transparent or translucent sticking base, (b) represents a line original (the black parts being line images), (c) represents a transparent or translucent sticking base, (d) represents a dot original (the black parts being dot images), and (e) represents a contact-type light-sensitive material (the hatched portion being a light-sensitive layer).

DETAILED DESCRIPTION OF THE INVENTION

Redox compounds capable of releasing a development inhibitor upon oxidation that are useful in the present invention include as a redox group, a hydroquinone moiety, a catechol moiety, a naphthohydroquinone moiety, an aminophenol moiety, a pyrazolidone moiety, a hydrazine moiety, a hydroxylamine moiety or a reductone moiety.

Preferred redox compounds have a hydrazine moiety as the redox group.

More preferred redox compounds are represented by formula (I):

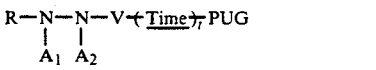

(I)

wherein $A_1$ and $A_2$ each represent a hydrogen atom or one of them represents a hydrogen atom and the other represents a sulfinic acid group or

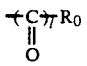

(where $R_0$ represents an alkyl group, an alkenyl group, an aryl group, an alkoxy group or an aryloxy group; and represents 1 or 2); Time represents a divalent linking group; t represents 0 or 1; PUG represents a moiety of a development inhibitor; V represents a carbonyl group,

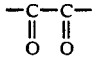

a sulfonyl group, a sulfoxy group,

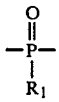

(wherein $R_1$ represents an alkoxy group or an aryloxy group), an iminomethylene group or a thiocarbonyl group; and R represents an aliphatic group, an aromatic group or a heterocyclic group.

More specifically, in formula (I) described above, $A_1$ and $A_2$ each represent a hydrogen atom; an alkylsulfonyl or arylsulfonyl group having not more than 20 carbon atoms (preferably a phenylsulfonyl group or a phenylsulfonyl group which is substituted so that the sum of the Hammett's substituent constant may be −0.5 or more);

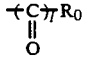

(where $R_0$ represents a straight chain, branched chain or cyclic alkyl group or alkenyl group preferably having not more than 30 carbon atoms, an aryl group (preferably a phenyl group or a phenyl group which is substituted so that the sum of the Hammett constants may be −0.5 or more); an alkoxy group (for example, ethoxy); or an aryloxy group (preferably a monocyclic aryloxy group). These groups may themselves be substituted with one or more substituents. Suitable substituents include, for example, an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxy group, an aryloxycarbonyl group, an acyl group, an alkoxycarbonyl group, an acyloxy group, a carbonamido group, a sulfonamido group, a nitro group, an alkylthio group, and an arylthio group. These substituents may also be further substituted.

The sulfinic acid group represented by $A_1$ or $A_2$ preferably represents one which is specifically described in U.S. Pat. No. 4,478,928.

Further, $A_1$ may be connected with $\text{-}(\underline{\text{Time}})_t\text{-}$ to form a ring.

$A_1$ and $A_2$ are most preferably hydrogen atoms.

In the general formula (I), Time represents a divalent linking group which may have a timing control function. t represents 0 or 1. When t is 0, PUG is directly connected to V.

If the divalent linking group represented by Time has a timing control function, Time represents a group which releases PUG through one or more reaction stages from $(\underline{\text{Time}})_t$ PUG which has itself been released from an oxidation product after the oxidation reduction of the mother skeleton.

The divalent linking groups represented by Time include, for example, those capable of releasing a photographically useful group (hereinafter simply referred to as "PUG") upon an intramolecular ring-closing reaction of a p-nitrophenoxy derivative (as described, for example, in U.S. Pat. No. 4,248,962 (JP-A-54-145135)); those capable of releasing PUG upon an intramolecular ring closing reaction after the ring cleavage (as described, for example, in U.S. Pat. Nos. 4,310,612 (JP-A-55-53330) and 4,358,255); those capable of releasing PUG accompanied with the formation of an acid anhydride upon an intramolecular ring closing reaction of a carboxy group of succinic acid mono-ester or analogue thereof (as described, for example, in U.S. Pat. Nos. 4,330,617, 4,446,216 and 4,483,919 and JP-A-59-121328); those capable of releasing PUG accompanied with the formation of quinonemonomethane or an analogue thereof upon electron transfer via conjugated double bonds of an aryloxy group or a heterocyclic oxy group (as described, for example, in U.S. Pat. Nos. 4,409,323 and 4,421,845, *Research Disclosure*, No, 21228 (December, 1981), U.S. Pat. No. 4,416,977 (JP-A-57-135944), JP-A-58-209736 and JP-A-58-209738); those capable of releasing PUG from the γ-position of enamine upon electron transfer in an enamine structure portion of a nitrogen-containing hetero ring (as described, for example, in U.S. Pat. No. 4,420,554 (JP-A-57-136640), JP-A-57-135945, JP-A-57-188035, JP-A-58-98728 and JP-A-58-209737); those capable of releasing PUG upon an intramolecular ring-closing reaction of an oxy group formed by electron transfer to a carbonyl group which is conjugated with a nitrogen atom in a nitrogen-containing hetero ring (as described, for example, in JP-A-57-56837); those capable of releasing PUG accompanied by the formation of an aldehyde (as described, for example, in U.S. Pat. No. 4,146,396 (JP-A-52-90932), JP-A-59-93442 and JP-A-59-75475); those capable of releasing PUG accompanied by the decarboxylation of carboxy group (as described, for example, in JP-A-51-146828, JP-A-57-179842 and JP-A-59-104641); those capable of releasing PUG from a structure—O—COOCRaRb—PUG accompanied by the decarboxylation and the subsequent formation of an aldehyde; those capable of releasing PUG accompanied by the formation of isocyanate (as described, for example, in JP-A-60-7429); and those capable of releasing PUG upon a coupling reaction with an oxidation product of a color developing agent (as described, for example, in U.S. Pat. No. 4,438,193).

Specific examples of the divalent linking group represented by Time are described in detail, for example, in JP-A-61-236549 and JP-A-1-269936.

Preferred specific examples of the divalent linking groups are set forth below, wherein a symbol (*) denotes the position at which $(\underline{\text{Time}})_t$ PUG is bonded to V, and a symbol (**) denotes the position at which PUG is bonded in formula (I).

T-(1)

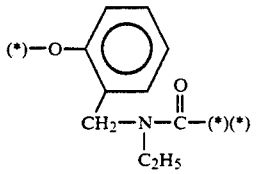

T-(2)

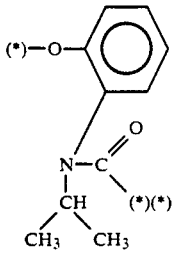

T-(3)

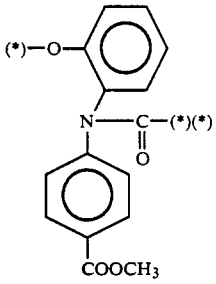

T-(4)

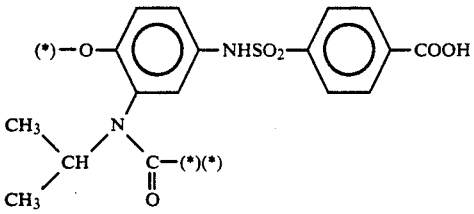

T-(5)

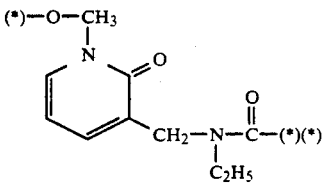

-continued

T-(6)

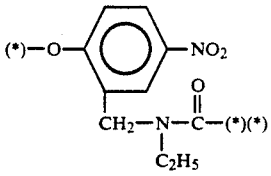

T-(7)

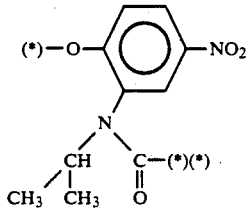

T-(8)

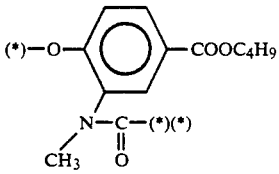

T-(9)

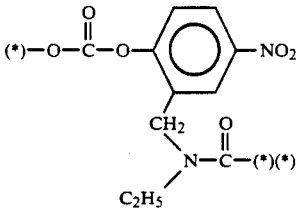

T-(10)

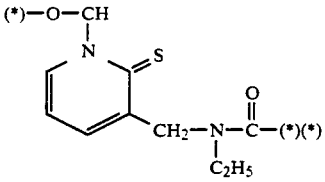

T-(11)

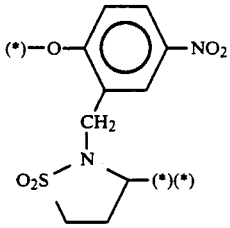

T-(12)

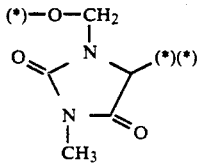

-continued
T-(13)
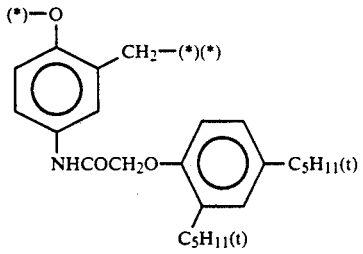
T-(14)
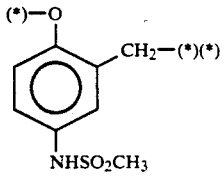
T-(15)
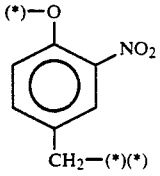
T-(16)
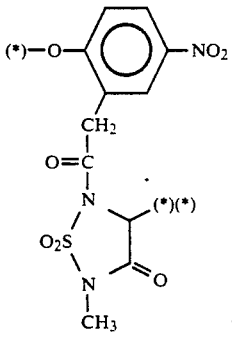
T-(17)
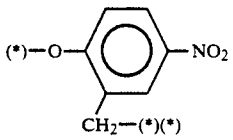
T-(18)
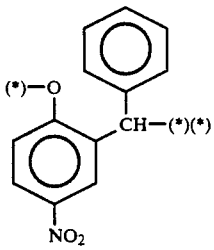
T-(19)
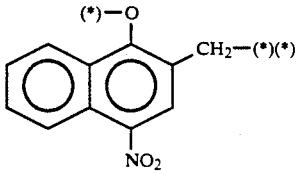
-continued
T-(20)
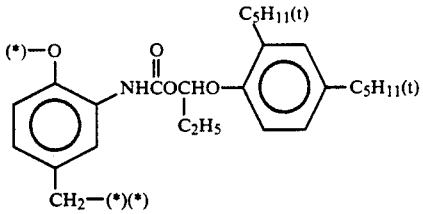
T-(21)
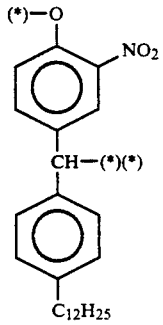
T-(22)
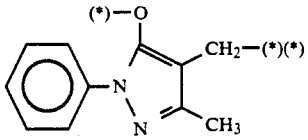
T-(23)
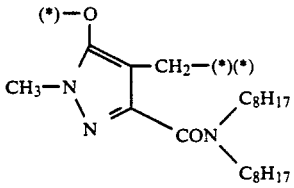
T-(24)
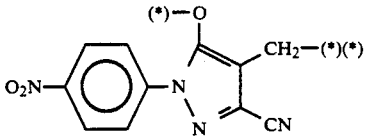
T-(25)
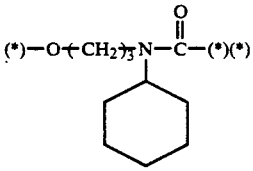
T-(26)
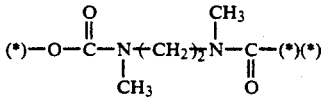
T-(27)
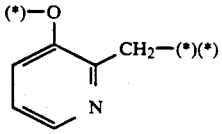

-continued

T-(28)

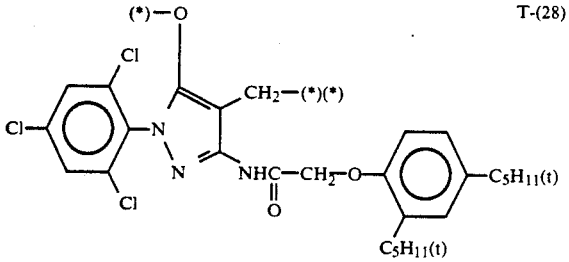

T-(29)

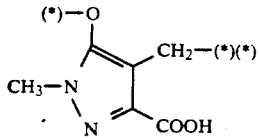

T-(30)

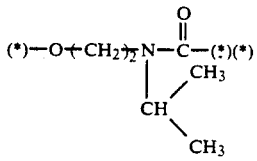

T-(31)

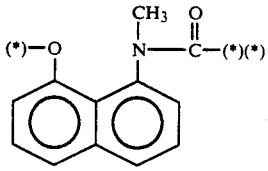

T-(32)

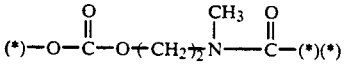

T-(33)

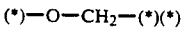

T-(34)

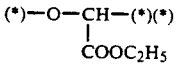

T-(35)

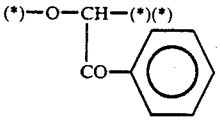

T-(36)

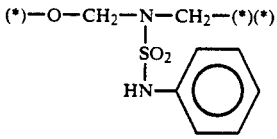

T-(37)

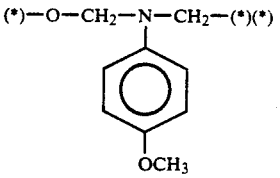

T-(38)

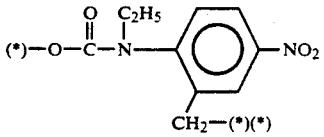

-continued

T-(39)

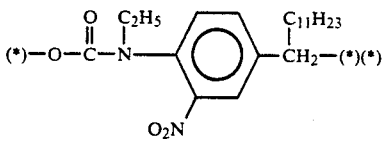

T-(40)

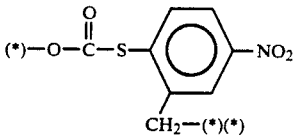

T-(41)

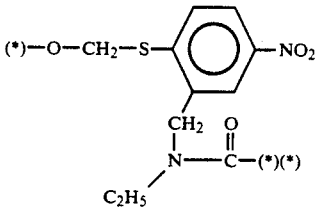

T-(42)

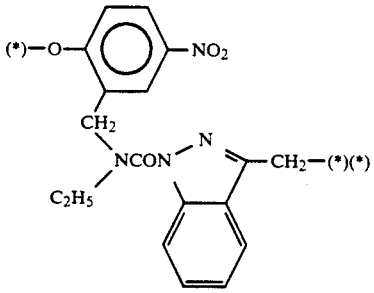

In formula (I), PUG represents a group which has a development inhibiting function as $\text{-}(\underline{\text{Time}})_t$ PUG or PUG.

The development inhibitor moiety represented by PUG or $\text{-}(\underline{\text{Time}})_t$ PUG is a known group carrying a hetero atom to which it is bonded. Examples of such groups are described, for example, in C. E. K. Mees and T.H. James, *The Theory of the Photographic Processes,* 3rd Ed., 344–346, Macmillan (1966). Specific examples include the mercaptotetrazoles, mercaptotriazoles, mercaptoimidazoles, mercaptopyrimidines, mercaptobenzimidazoles, mercaptobenzothiazoles, mercaptobenzoxazoles, mercaptothiadiazoles, benzotriazoles, benzimidazoles, indazoles, adenines, guanines, tetrazoles, tetraazaindenes, triazaindenes, and mercaptoaryls.

The development inhibitor moiety represented by PUG may itself be substituted with one or more substituents. Suitable examples of these substituents include an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, an alkyloxycarbonyl group, an aryloxycarbonyl group, an acyl group, an alkoxycarbonyl group, an acyloxy group, a carbonamido group, a sulfonamido group, a carboxy group, a sulfoxy group, a phosphono group, a phosphynyl group, and a phosphoramido group. These substituents may be further substituted with additional substituents.

Preferred examples of these additional substituents are a nitro group, a sulfo group, a carboxy group, a sulfamoyl group, a phosphono group, a phosphynyl group, and a sulfonamido group.

Specific examples of the development inhibitors which can be used in the present invention are shown below:

1. Mercaptotetrazole Derivatives
(1) 1-Phenyl-5-mercaptotetrazole
(2) 1-(4-Hydroxyphenyl)-5-mercaptotetrazole
(3) 1-(4-Aminophenyl)-5-mercaptotetrazole
(4) 1-(4-Carboxyphenyl)-5-mercaptotetrazole
(5) 1-(4-Chlorophenyl)-5-mercaptotetrazole
(6) 1-(4-Methylphenyl)-5-mercaptotetrazole
(7) 1-(2,4-Dihydroxyphenyl)-5-mercaptotetrazole
(8) 1-(4-Sulfamoylphenyl)-5-mercaptotetrazole
(9) 1-(3-Carboxyphenyl)-5-mercaptotetrazole
(10) 1-(3,5-Dicarboxyphenyl)-5-mercaptotetrazole
(11) 1-(4-Methoxyphenyl)-5-mercaptotetrazole
(12) 1-(2-Methoxyphenyl)-5-mercaptotetrazole
(13) 1-[4-(2-Hydroxyethoxy)phenyl]-5-mercaptotetrazole
(14) 1-(2,4-Dichlorophenyl)-5-mercaptotetrazole
(15) 1-(4-Dimethylaminophenyl)-5-mercaptotetrazole
(16) 1-(4-Nitrophenyl)-5-mercaptotetrazole
(17) 1,4-Bis(5-mercapto-1-tetrazolyl)benzene
(18) 1-(α-Naphthyl)-5-mercaptotetrazole
(19) 1-(4-Sulfophenyl)-5-mercaptotetrazole
(20) 1-(3-Sulfophenyl)-5-mercaptotetrazole
(21) 1-(β-Naphthyl)-5-mercaptotetrazole
(22) 1-Methyl-5-mercaptotetrazole
(23) 1-Ethyl-5-mercaptotetrazole
(24) 1-Propyl-5-mercaptotetrazole
(25) 1-Octyl-5-mercaptotetrazole
(26) 1-Dodecyl-5-mercaptotetrazole
(27) 1-Cyclohexyl-5-mercaptotetrazole
(28) 1-Palmityl-5-mercaptotetrazole
(29) 1-Carboxyethyl-5-mercaptotetrazole
(30) 1-(2,2-Diethoxyethyl)-5-mercaptotetrazole
(31) 1-(2-Aminoethyl)-5-mercaptotetrazole hydrochloride
(32) 1-(2-Diethylaminoethyl)-5-mercaptotetrazole
(33) 2-(5-Mercapto-1-tetrazolyl)ethyltrimethylammonium chloride
(34) 1-(3-Phenoxycarbonylphenyl)-5-mercaptotetrazole
(35) 1-(3-Maleinimidophenyl)-5-mercaptotetrazole 2. Mercaptotriazole Derivatives
(1) 4-Phenyl-3-mercaptotriazole
(2) 4-Phenyl-5-methyl-3-mercaptotriazole
(3) 4,5-Diphenyl-3-mercaptotriazole
(4) 4-(4-Carboxyphenyl)-3-mercaptotriazole
(5) 4-Methyl-3-mercaptotriazole
(6) 4-(2-Dimethylaminoethyl)-3-mercaptotriazole
(7) 4-(α-Naphthyl)-3-mercaptotriazole
(8) 4-(4-Sulfophenyl)-3-mercaptotriazole
(9) 4-(3-Nitrophenyl)-3-mercaptotriazole 3. Mercaptoimidazole Derivatives
(1) 1-Phenyl-2-mercaptoimidazole
(2) 1,5-Diphenyl-2-mercaptoimidazole
(3) 1-(4-Caboxyphenyl)-2-mercaptoimidazole
(4) 1-(4-Hexylcarbamoyl)-2-mercaptoimidazole
(5) 1-(3-Nitrophenyl)-2-mercaptoimidazole
(6) 1-(4-Sulfophenyl)-2-mercaptoimidazole 4. Mercaptopyrimidine Derivatives
(1) Thiouracil
(2) Methylthiouracil
(3) Ethylthiouracil
(4) Propylthiouracil
(5) Nonylthiouracil
(6) Aminothiouracil
(7) Hydroxythiouracil 5. Mercaptobenzimidazole Derivatives
(1) 2-Mercaptobenzimidazole
(2) 5-Carboxy-2-mercaptobenzimidazole
(3) 5-Amino-2-mercaptobenzimidazole
(4) 5-Nitro-2-mercaptobenzimidazole
(5) 5-Chloro-2-mercaptobenzimidazole
(6) 5-Methoxy-2-mercaptobenzimidazole
(7) 2-Mercaptonaphthoimidazole
(8) 2-Mercapto-5-sulfobenzimidazole
(9) 1-(2-Hydroxyethyl)-2-mercaptobenzimidazole
(10) 5-Caproamido-2-mercaptobenzimidazole
(11) 5-(2-Ethylhexanoylamino)-2-mercaptobenzimidazole 6. Mercaptothiadiazole Derivatives
(1) 5-Methylthio-2-mercapto-1,3,4-thiadiazole
(2) 5-Ethylthio-2-mercapto-1,3,4-thiadiazole
(3) 5-(2-Dimethylaminoethylthio)-2-mercapto-1,3,4-thiadiazole
(4) 5-(2-Carboxypropylthio)-2-mercapto-1,3,4-thiadiazole
(5) 2-(Phenoxycarbonylmethylthio)-5-mercapto-1,3,4-thiadiazole 7. Mercaptobenzothiazole Derivatives
(1) 2-Mercaptobenzothiazole
(2) 5-Nitro-2-mercaptobenzothiazole
(3) 5-Carboxy-2-mercaptobenzothiazole
(4) 5-Sulfo-2-mercaptobenzothiazole 8. Mercaptobenzoxazole Derivatives
(1) 2-Mercaptobenzoxazole
(2) 5-Nitro-2-mercaptobenzoxazole
(3) 5-Carboxy-2-mercaptobenzoxazole
(4) 5-Sulfo-2-mercaptobenzoxazole 9. Benzotriazole Derivatives
(1) 5,6-Dimethylbenzotriazole
(2) 5-Butylbenzotriazole
(3) 5-Methylbenzotriazole
(4) 5-Chlorobenzotriazole
(5) 5-Bromobenzotriazole
(6) 5,6-Dichlorobenzotriazole
(7) 4,6-Dichlorobenzotriazole
(8) 5-Nitrobenzotriazole
(9) 4-Nitro-6-chlorobenzotriazole
(10) 4,5,6-Trichlorobenzotriazole
(11) 5-Carboxybenzotriazole
(12) 5-Sulfobenzotriazole sodium salt
(13) 5-Methoxycarbonylbenzotriazole
(14) 5-Aminobenzotriazole
(15) 5-Butoxybenzotriazole
(16) 5-Ureidobenzotriazole
(17) Benzotriazole
(18) 5-Phenoxycarbonylbenzotriazole
(19) 5-(2,3-Dichloropropyloxycarbonyl)benzotriazole 10. Benzimidazole Derivatives
(1) Benzimidazole
(2) 5-Chlorobenzimidazole
(3) 5-Nitrobenzimidazole
(4) 5-n-Butylbenzimidazole
(5) 5-Methylbenzimidazole
(6) 4-Chlorobenzimidazole
(7) 5,6-Dimethylbenzimidazole
(8) 5-Nitro-2-trifluoromethylbenzimidazole 11. Indazole Derivatives
(1) 5-Nitroindazole (2) 6-Nitroindazole
(3) 5-Aminoindazole
(4) 6-Aminoindazole
(5) Indazole
(6) 3-Nitroindazole
(7) 5-Nitro-3-chloroindazole
(8) 3-Chloro-5-nitroindazole
(9) 3-Carboxy-5-nitroindazole
12. Tetrazole Derivatives
(1) 5-(4-Nitrophenyl)tetrazole
(2) 5-Phenyltetrazole
(3) 5-(3-Carboxyphenyl)tetrazole
13. Tetraazaindene Derivatives
(1) 4-Hydroxy-6-methyl-5-nitro-1,3,3a,7-tetraazaindene
(2) 4-Mercapto-6-methyl-5-nitro-1,3,3a,7-tetraazaindene
14. Mercaptoaryl Derivatives
(1) 4-Nitrothiophenol
(2) Thiophenol
(3) 2-Carboxythiophenol In formula (I), V represents a carbonyl group,

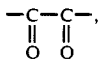

a sulfonyl group, a sulfoxy group,

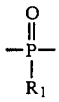

(wherein $R_1$ represents an alkoxy group or an aryloxy group), an iminomethylene group or a thiocarbonyl group. Preferably, V represents a carbonyl group.

The aliphatic group represented by R in formula (I) includes a straight chain, branched chain or cyclic alkyl group, alkenyl group, or alkynyl group. These group preferably contain from 1 to 30 carbon atoms; most preferably from 1 to 20 carbon atoms. The branched chain alkyl group may contain one or more hetero atoms to form a saturated hetero ring.

Specific examples of the aliphatic group include a methyl group, a tert-butyl group, an n-octyl group, a tert-octyl group, a cyclohexyl group, a hexenyl group, a pyrrolidyl group, a tetrahydrofuryl group, and an n-dodecyl group.

The aromatic group represented by R includes a monocyclic or bicyclic aryl group, for example, a phenyl group or a naphthyl group.

The heterocyclic group represented by R includes a 3-membered to 10-membered saturated or unsaturated heterocyclic group containing at least one nitrogen atom, oxygen atom, or sulfur atom, and may be a monocyclic ring or form a condensed ring together with an aromatic ring or a heterocyclic ring. A 5-membered or 6-membered aromatic heterocyclic group is preferred. Specific examples of the heterocyclic group are a pyridyl group, an imidazolyl group, a quinolinyl group, a benzimidazolyl group, a pyrimidyl group, a pyrazolyl group, an isoquinolinyl group, a benzothiazolyl group, and a thiazolyl group.

The group represented by R may also be substituted with one or more substituents. Suitable examples of the substituent include an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an alkyloxycarbonyl group, an aryloxycarbonyl group, an acyl group, an alkoxycarbonyl group, an acyloxy group, a carbonamido group, a sulfonamido group, a carboxy group, and a phosphonamido group. These groups may be further substituted.

In the compound represented by formula (I), a ballast group which is conventionally employed in immobile photographic additives such as couplers, or a group which is capable of accelerating the adsorption onto silver halide may be incorporated into R or (Time-)$_t$ PUG of formula (I).

The ballast group is an organic group which provides sufficient molecular weight to substantially prevent the compound represented by formula (I) from diffusing into other layers or a processing solution. Ballast groups useful in the present invention are alkyl, aryl, heterocyclic, ether, thioether, amido, ureido, urethane, and sulfonamido groups, or a combination of two or more of these groups. Preferably the ballast group is a group containing a substituted benzene ring; most preferably a ballast group containing a benzene ring substituted with a branched alkyl group.

Adsorption acceleration groups usable with the invention are cyclic thioamido groups, for example, 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-oxadiazoline-thione, benzothiazoline-2-thione, thiotriazine and 1,3-imidazoline-2-thione, a chain thioamido group, an aliphatic mercapto group, an aromatic mercapto group, a heterocyclic mercapto group (when the atom adjacent to the carbon atom bonded to -SH group is a nitrogen atom, the mercapto group has the same meaning as a cyclic thioamide group related tautomerically to it; the above groups are specific examples of this), a group having a disulfido bond, a 5-membered or 6-membered nitrogen-containing heterocyclic ring comprising a combination of nitrogen, oxygen, sulfur, and carbon (such as benzotriazole, triazole, tetrazole, indazole, benzimidazole, imidazole, benzothiazole, thiazole, thiazoline, benzoxazole, oxazole, oxazoline, thiadiazole, oxathiazole, triazine and azaindene), and a heterocyclic quaternary salt (such as benzimidazolinium).

These groups may be further substituted with one or more appropriate substituents selected from those described for R above.

Specific examples of compounds represented by formula (I) which can be employed in the present invention are set forth below, but the present invention is not to be construed as being limited to these compounds.

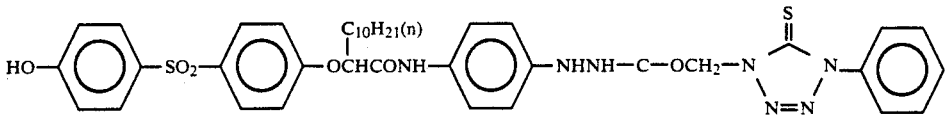

I-1

-continued
I-2
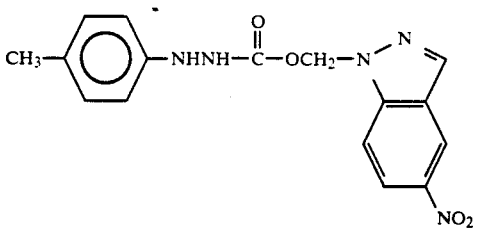
I-3
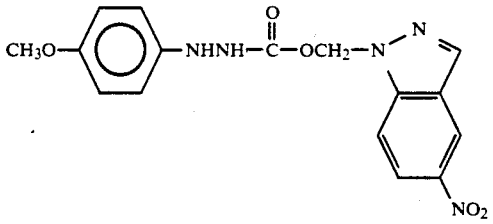
I-4
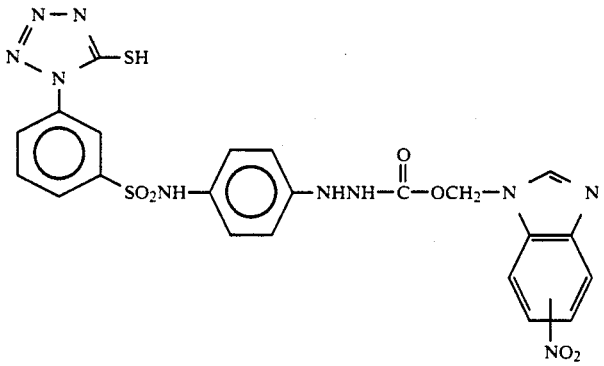
I-5
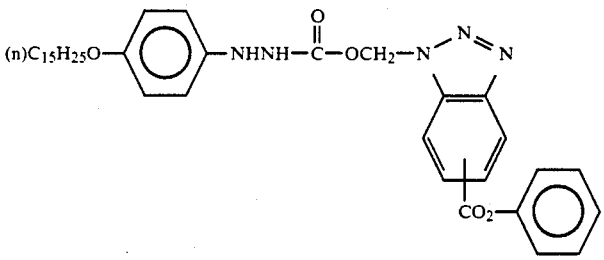
I-6
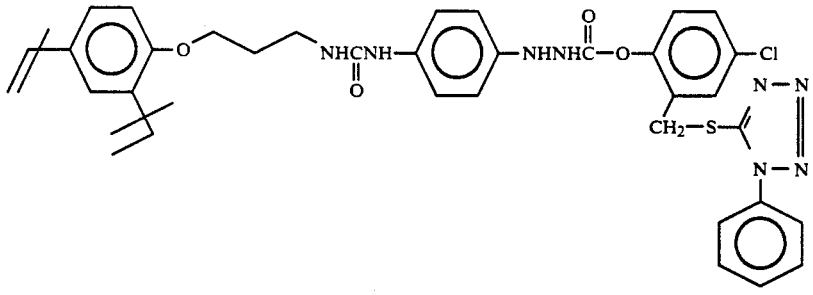
I-7
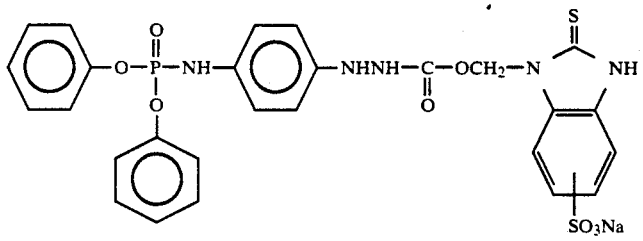

-continued
I-8
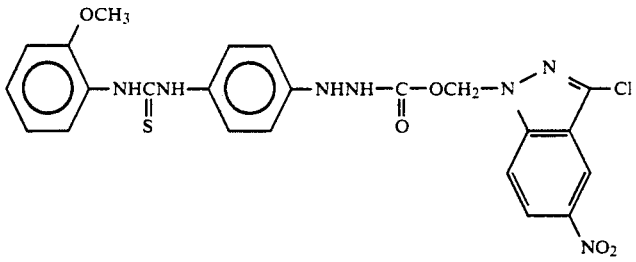
I-9
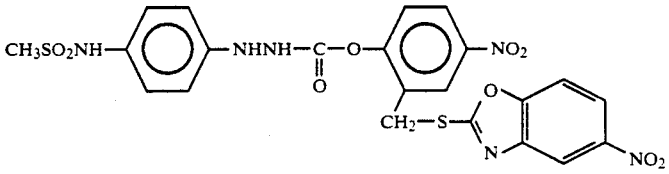
I-10
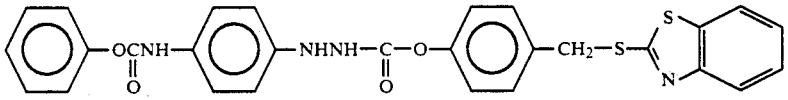
I-11
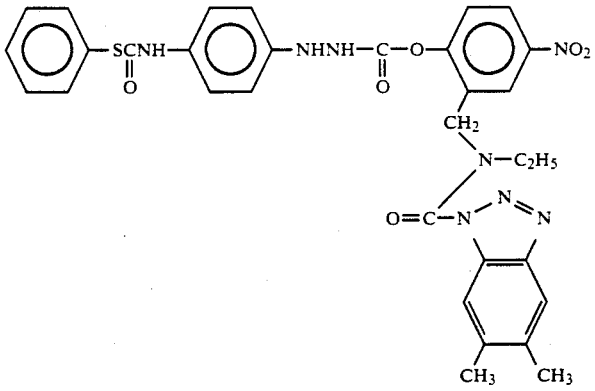
I-12
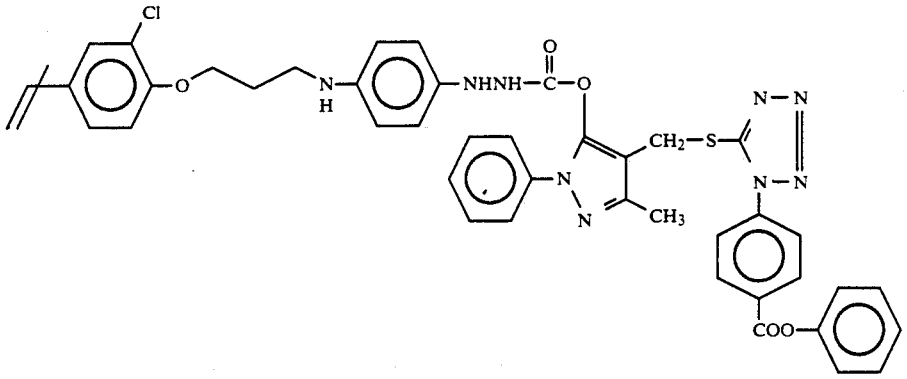

-continued
I-13
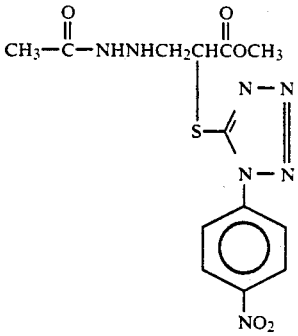
I-14
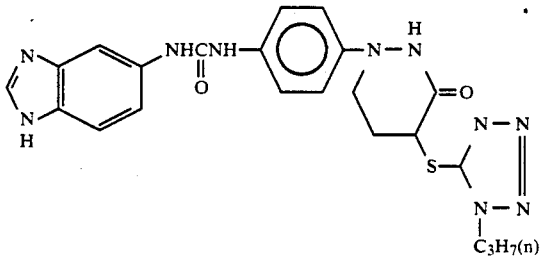
I-15
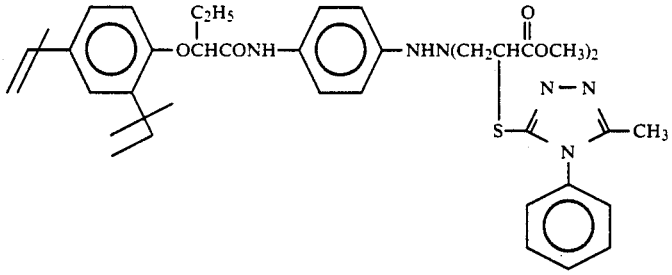
I-16
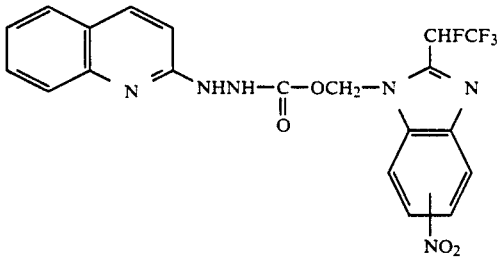
I-17
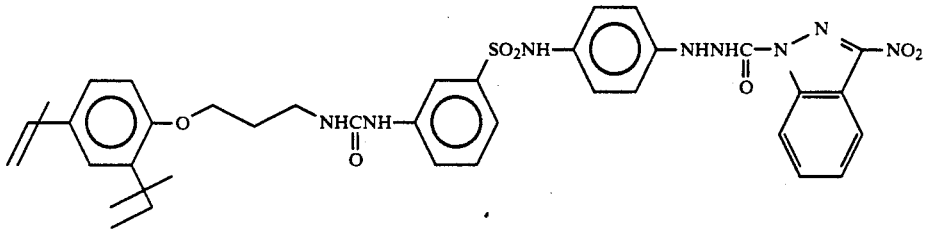
I-18
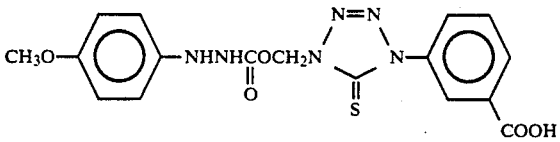

-continued
I-19
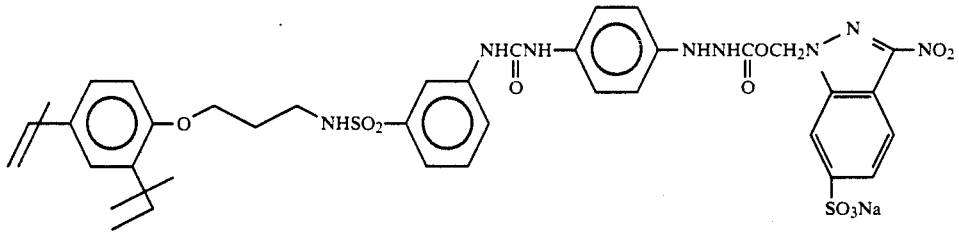
I-20
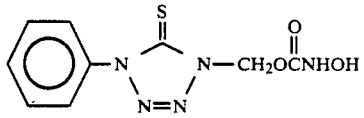
I-21
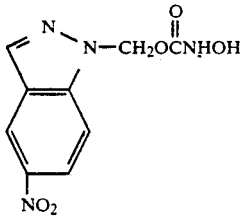
I-22
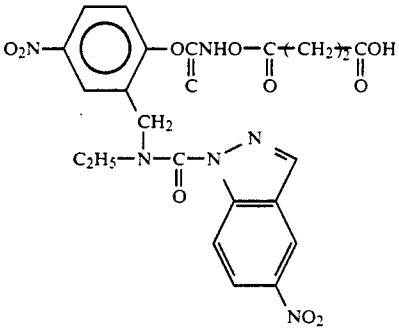
I-23
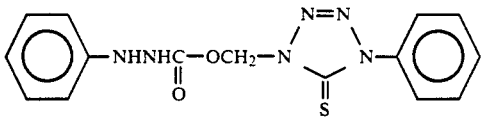
I-24
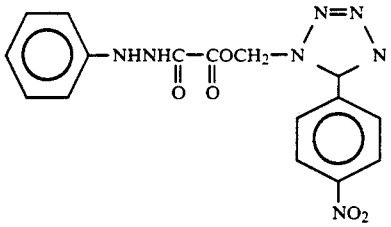
I-25
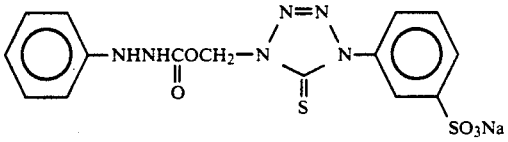

-continued
I-26
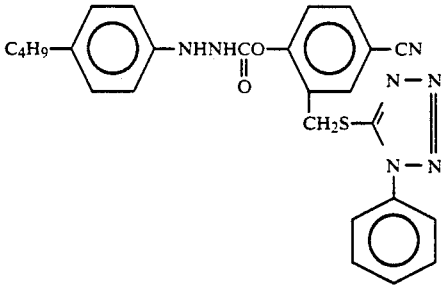
I-27
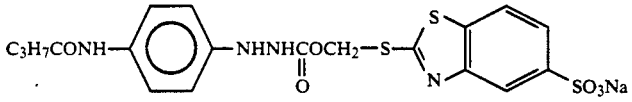
I-28
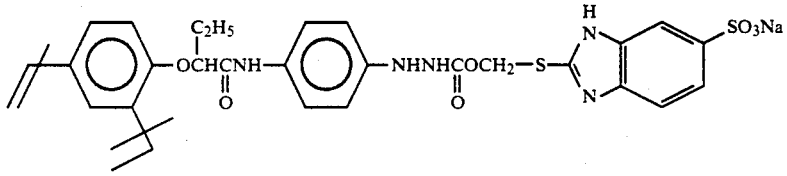
I-29
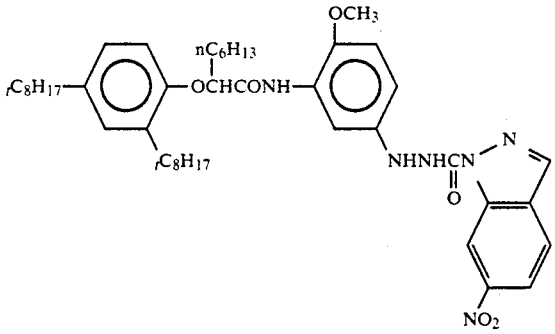
I-30
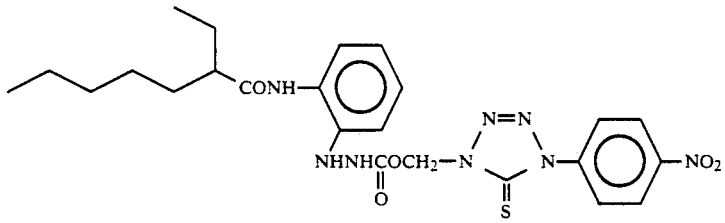
I-31
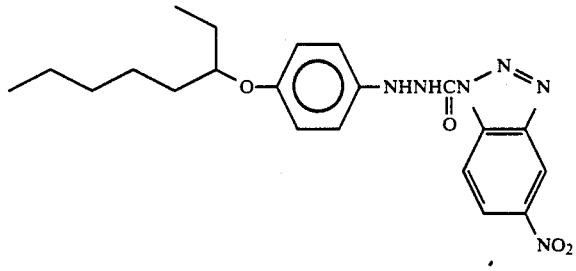
I-32
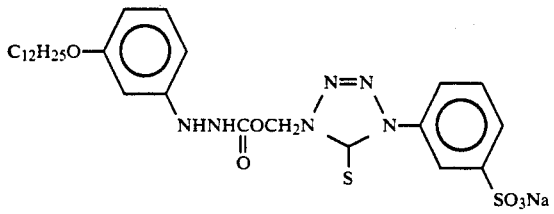

-continued
I-33
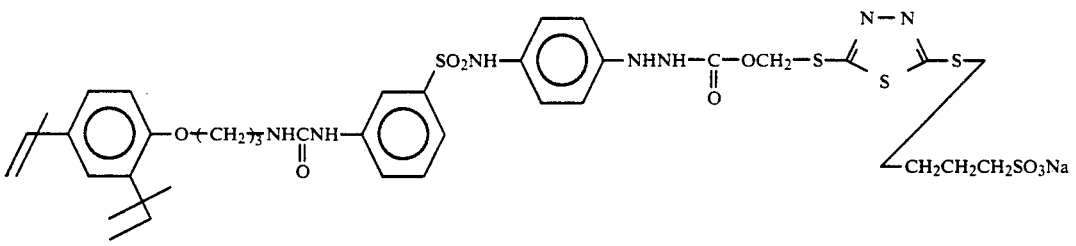
I-34
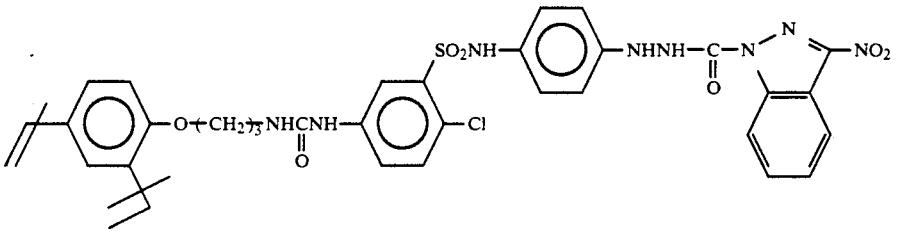
I-35
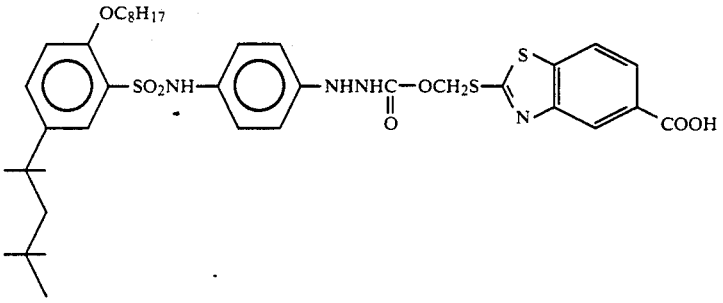
I-36
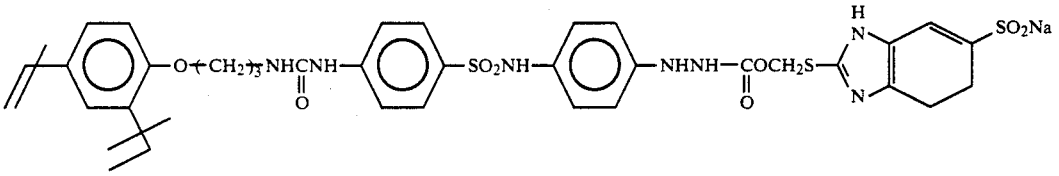
I-37
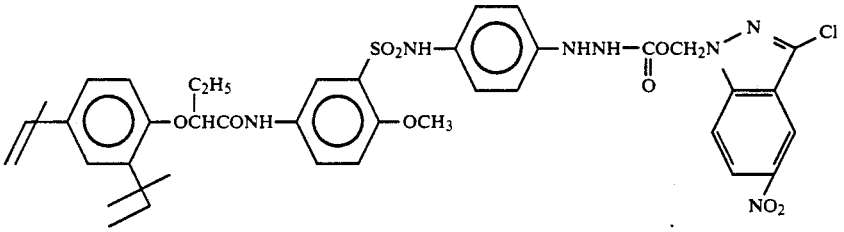
I-38
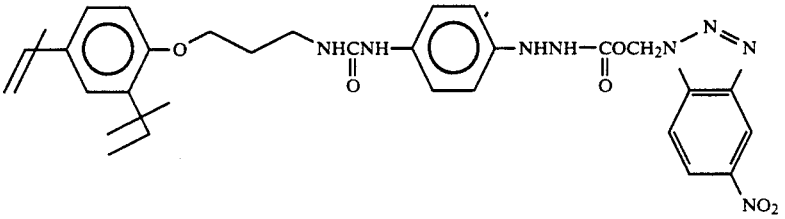

-continued
I-39
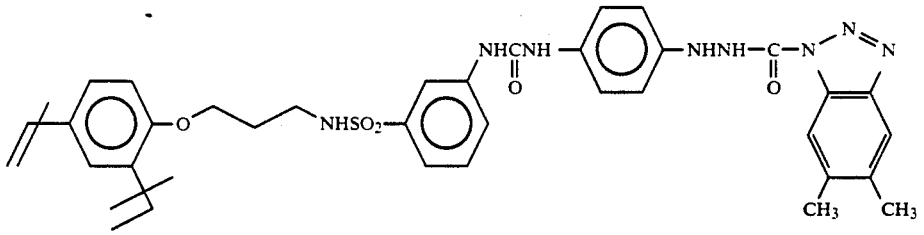
I-40
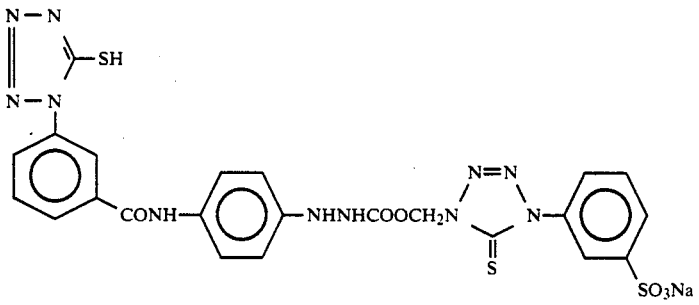
I-41
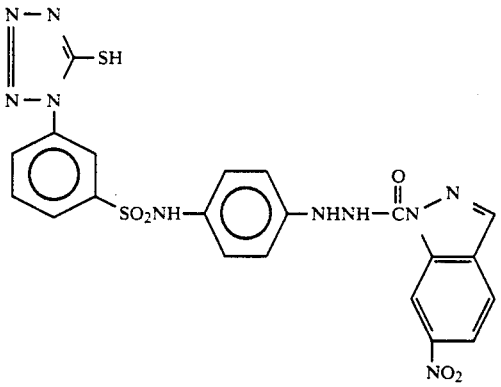
I-42
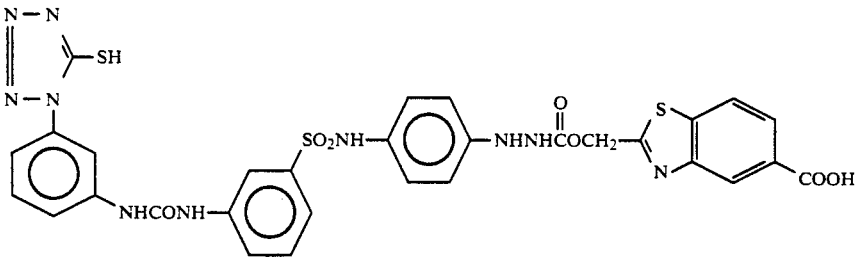
I-43
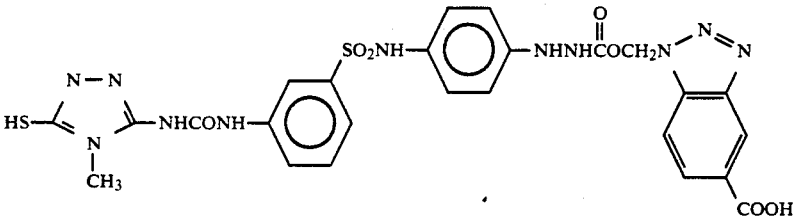
I-44
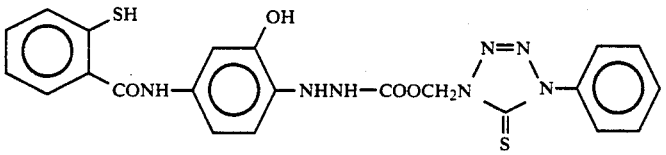

-continued
I-45
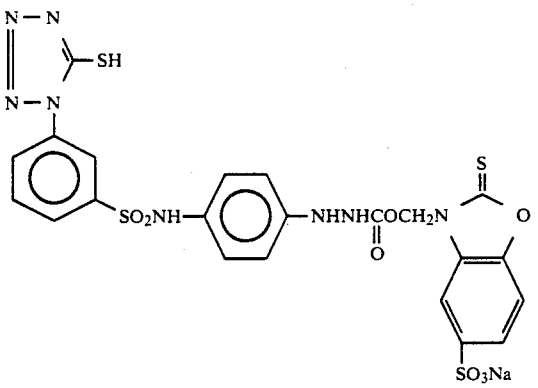
I-46
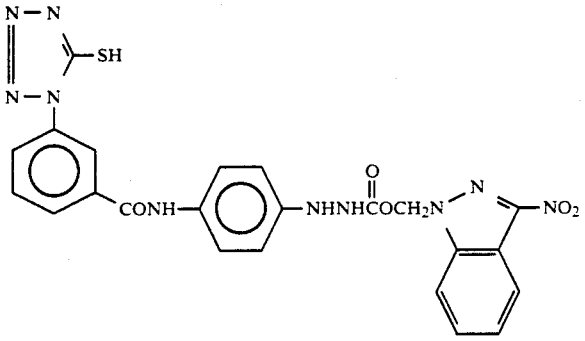
I-47
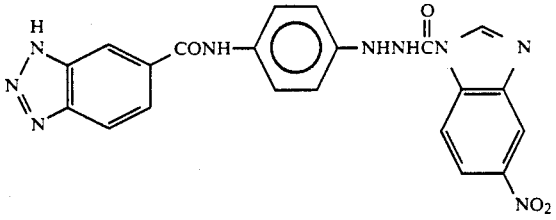
I-48
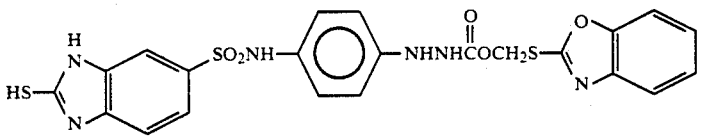
I-49
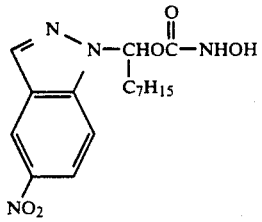
I-50
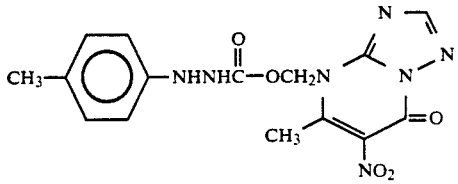

-continued
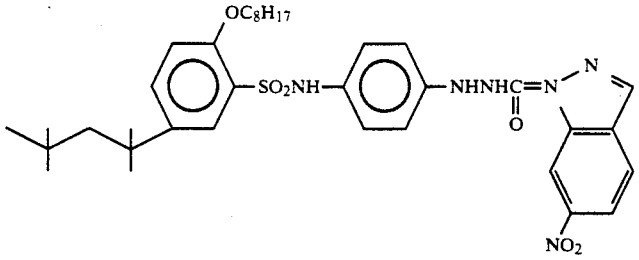
I-51
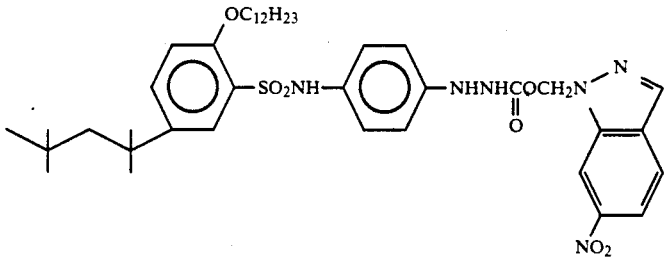
I-52
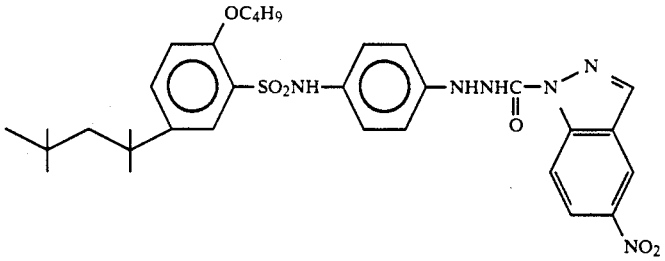
I-53
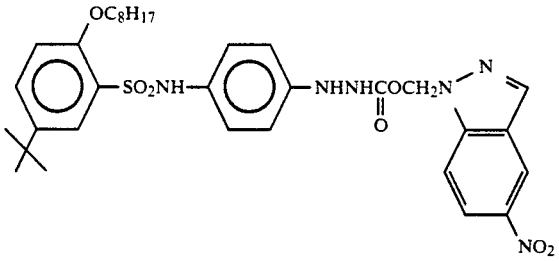
I-54
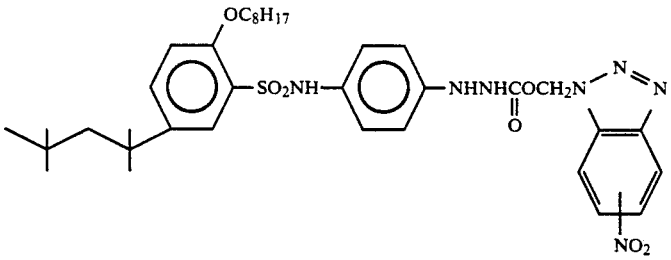
I-55
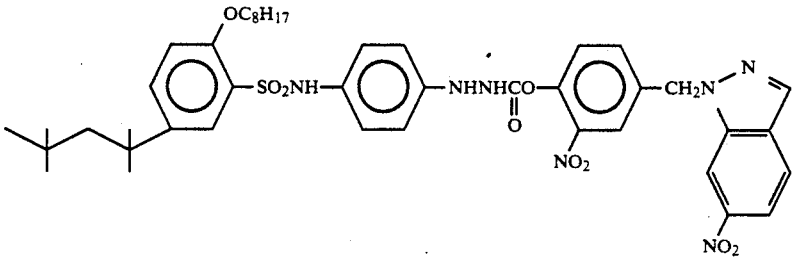
I-56

-continued

I-57

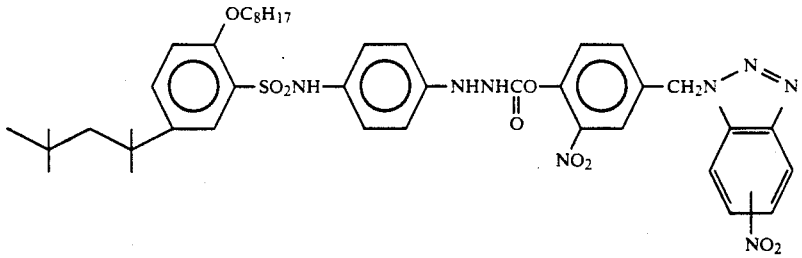

I-58

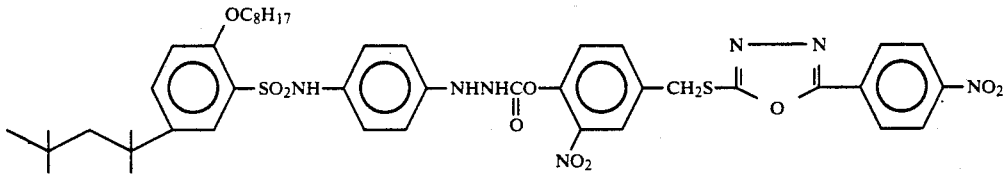

I-59

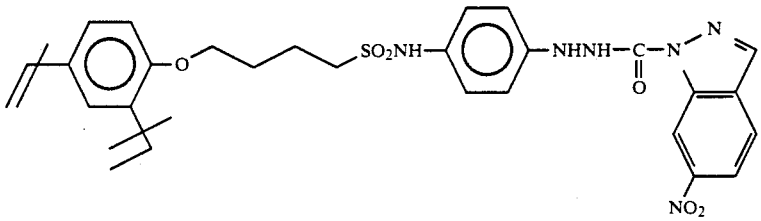

I-60

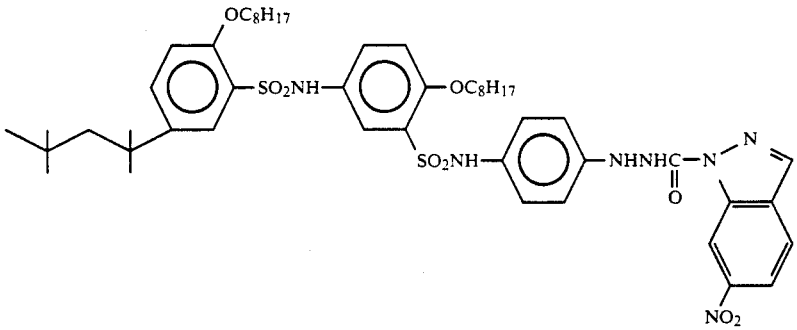

I-61

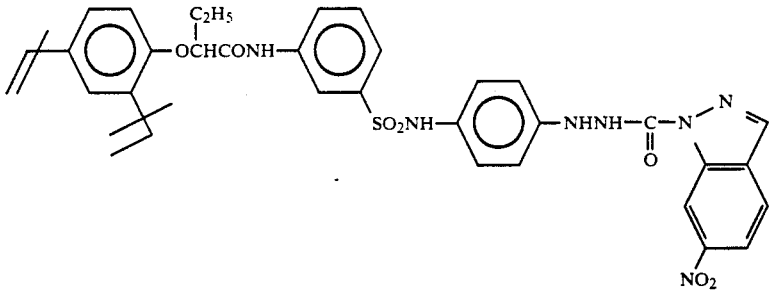

The redox compound of the present invention is generally employed in a range of from about $1.0\times10^{-7}$ mol/m$^2$ to about $1.0\times10^{-3}$ mol/m$^2$; preferably from about $1.0\times10^{-6}$ mol/m$^2$ to about $1.0\times10^{-4}$ mol/m$^2$.

The redox compound of the present invention may be dissolved in an appropriate water-miscible organic solvent, for example, an alcohol (e.g., methanol, ethanol, propanol, or a fluorinated alcohol), a ketone (e.g., acetone, or methyl ethyl ketone), dimethylformamide, dimethylsulfoxide, or methyl cellosolve. It can be dissolved in an oil such as dibutyl phthalate, tricresyl phosphate, glycerol triacetate, or diethylphthalate together with an auxiliary solvent such as ethyl acetate, or cyclohexanone and dispersed mechanically to form an emulsified dispersion as known from WO 88/04794. Powdered redox compound can also be dispersed in water using a ball mill, a colloid mill, or ultrasonic dispersion means according to solid dispersion methods known in the art.

The layer containing the redox compound in the present invention can be positioned above or below the light-sensitive silver halide emulsion layer that contains the hydrazine nucleating agent. The redox containing layer may also contain light-sensitive or light-insensitive silver halide grains. Between the redox containing layer and the light-sensitive silver halide emulsion layer that contains the hydrazine nucleating agent an intermediate layer containing gelatin or a synthetic polymer (e.g., polyvinyl acetate, or polyvinyl alcohol) may be positioned.

The hydrazine derivative used in the present invention is preferably a compound represented by formula (II):

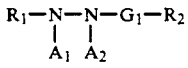

(II)

wherein $R_1$ represents an aliphatic group or an aromatic group; $R_2$ represents a hydrogen atom, an alkyl group, an aryl group, an alkoxyl group, an aryloxy group, an amino group, a hydrazino group, a carbamoyl group, or an oxycarbonyl group; $G_1$ represents a carbonyl group, a sulfonyl group, a sulfoxy group, a

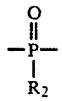

group (where $R_2$ is as defined above), a

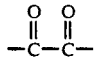

group, a thiocarbonyl group, or an iminomethylene group; $A_1$ and $A_2$ each represents a hydrogen atom, or one of $A_1$ and $A_2$ represents a hydrogen atom, and the other represents a substituted or unsubstituted alkylsulfonyl group, a substituted or unsubstituted arylsulfonyl group, or a substituted or unsubstituted acyl group.

In formula (II), the aliphatic group represented by $R_1$ is preferably an aliphatic group containing from 1 to 30 carbon atoms. More preferably, it is a straight chain, branched, or cyclic alkyl group having from 1 to 20 carbon atoms. The branched alkyl group may be cyclized to form a saturated heterocyclic ring containing at least one hetero atom. The alkyl group may be substituted with, for example, an aryl group, an alkoxyl group, a sulfoxy group, a sulfonamido group, or a carbonamido group.

The aromatic group represented by $R_1$ in formula (II) is a monocyclic or bicyclic aryl group or an unsaturated heterocyclic group. The unsaturated heterocyclic group may be condensed with a monocyclic or bicyclic aryl group to form a heteroaryl group. Examples of the aromatic group are a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothiazole ring. Hydrazine derivatives containing a benzene ring are particularly preferred.

$R_1$ particularly preferably represents an aryl group.

The aryl group or unsaturated heterocyclic group represented by $R_1$ may be substituted with, for example, an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, an alkyloxycarbonyl group, an aryloxycarbonyl group, an acyl group, an alkoxycarbonyl group, an acyloxy group, a carbonamido group, a sulfonamido group, a carboxy group, a phosphoramido group, a diacylamino group, an imido group, or an

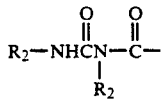

group (where $R_2$ is as defined above). Preferred examples of these substituents are a straight chain, branched, or cyclic alkyl group (preferably having from 1 to 20 carbon atoms); an aralkyl group (preferably a monocyclic or bicyclic group having from 1 to 3 carbon atoms in the alkyl moiety thereof); an alkoxyl group (preferably having from 1 to 20 carbon atoms); a substituted amino group (preferably an amino group substituted with an alkyl group having from 1 to 20 carbon atoms); an acylamino group (preferably having from 2 to 30 carbon atoms); a sulfonamido group (preferably having from 1 to 30 carbon atoms); a ureido group (preferably having from 1 to 30 carbon atoms); and a phosphoramido group (preferably having from 1 to 30 carbon atoms).

The alkyl group represented by $R_2$ in formula (II) preferably contains from 1 to 4 carbon atoms and may have a substituent, such as a halogen atom, a cyano group, a carboxy group, a sulfo group, an alkoxyl group, a phenyl group, an acyl group, an alkoxycarbonyl group, an aryloxycarbonyl group, a carbamoyl group, an alkylsulfo group, an arylsulfo group, a sulfamoyl group, a nitro group, a heteroaromatic group, or an

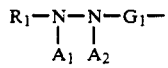

group (where $R_1$, $A_1$, $A_2$ and $G_1$ each is as defined above). These groups may further be substituted.

The aryl group represented by $R_2$ preferably includes a monocyclic or bicyclic aryl group, such as a benzene ring. The aryl group may have one or more substituents including those described for the alkyl group above.

The alkoxyl group represented by $R_2$ preferably contains from 1 to 8 carbon atoms and may be substituted, for example, with a halogen atom or an aryl group.

The aryloxy group represented by $R_2$ is preferably monocyclic and may be substituted, for example, with a halogen atom.

The amino group represented by $R_2$ may be substituted, for example, with an alkyl group, a halogen atom, a cyano group, a nitro group, or a carboxyl group. Preferably included in the amino group are an unsubstituted amino group, an alkylamino group having from 1 to 10 carbon atoms, or an arylamino group.

The carbamoyl group represented by $R_2$ may be substituted, for example, with an alkyl group, a halogen atom, a cyano group, or a carboxy group. Preferably included in the carbamoyl group are an unsubstituted carbamoyl group, an alkylcarbamoyl group having from 1 to 10 carbon atoms, and an arylcarbamoyl group.

The oxycarbonyl group represented by $R_2$ preferably is an alkoxycarbonyl group having from 1 to 10 carbon atoms or an aryloxycarbonyl group. The oxycarbonyl group may be substituted, for example, with an alkyl group, a halogen atom, a cyano group, or a nitro group.

Where $G_1$ is a carbonyl group, $R_2$ preferably represents a hydrogen atom, an alkyl group (e.g., methyl, trifluoromethyl, 3-hydroxypropyl, 3-methanesulfonamidopropyl, and phenylsulfonylmethyl), an aralkyl group (e.g., o-hydroxybenzyl), or an aryl group (e.g., phenyl, 3,5-dichlorophenyl, o-methanesulfonamidophenyl, and 4-methanesulfonylphenyl). More preferably $G_1$ is a hydrogen atom.

Where $G_1$ is a sulfonyl group, $R_2$ preferably represents an alkyl group (e.g., methyl), an aralkyl group (e.g., o-hydroxyphenylmethyl), an aryl group (e.g., phenyl), or a substituted amino group (e.g., dimethylamino).

Where $G_1$ is a sulfoxy group, $R_2$ preferably represents a cyanobenzyl group or a methylthiobenzyl group.

Where $G_1$ is $$-\overset{\overset{O}{\|}}{\underset{\underset{R_2}{|}}{P}}-,$$

$R_2$ preferably represents a methoxy group, an ethoxy group, a butoxy group, a phenoxy group, or a phenyl group, and more preferably a phenoxy group.

Where $G_1$ is an N-substituted or unsubstituted iminomethylene group, $R_2$ preferably represents a methyl group, an ethyl group, or a substituted or unsubstituted phenyl group.

Substituents applicable to $R_2$ include those enumerated above as the substituents of $R_1$.

In formula (II), $G_1$ most preferably represents a carbonyl group.

$R_2$ may be a group which makes the $G_1$-$R_2$ moiety be split off from the remainder of formula (II) to induce cyclization producing a cyclic structure containing the $-G_1-R_2$ moiety. More specifically, such a group is represented by formula (a):

$$-R_3-Z_1 \qquad \text{(a)}$$

wherein $Z_1$ represents a group which nucleophilically attacks $G_1$ to split the $G_1-R_3-Z_1$ moiety from the remainder; $R_3$ represents a group derived by removing one hydrogen atom from $R_2$; and $R_3$ and $Z_1$ form a cyclic structure together with $G_1$ upon nucleophilic attack of $Z_1$ on $G_1$.

More specifically, when the hydrazine compound of formula (II) undergoes any reaction such as oxidation to produce an intermediate represented by the formula of $R_1-N=N-G_1-R_3-Z_1$, $Z_1$ easily reacts nucleophilically with $G_1$ to split $R_1-N=N$ from $G_1$. A group such as $Z_1$ includes a functional group capable of directly reacting with $G_1$, e.g., OH, SH, $NHR_4$ (where $R_4$ represents a hydrogen atom, an alkyl group, an aryl group, $-COR_5$, or $-SO_2R_5$, where $R_5$ represents a hydrogen atom, an alkyl group, an aryl group, or a heterocyclic group), and —COOH (these functional groups may be temporarily protected so as to release the functional group upon hydrolysis with, for example, an alkali) and a functional group which is capable of reacting with $G_1$ after reacting with a nucleophilic agent (e.g., a hydroxide ion and a sulfite ion) such as $$-\overset{\overset{O}{\|}}{C}-R_6$$

and $$-\overset{\overset{N-R_7}{\|}}{C}-R_6$$

(wherein $R_6$ and $R_7$ each represents a hydrogen atom, an alkyl group, an alkenyl group, an aryl group, or a heterocyclic group).

The ring formed by $G_1$, $R_3$, and $Z_1$ is preferably a 5-membered or 6-membered ring.

Preferred groups represented by formula (a) are represented by formula (b) or (c) described below.

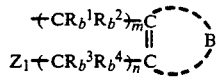

(b)

wherein $Z_1$ is as defined above; $R_b^1$, $R_b^2$, $R_b^3$, and $R_b^4$, may be the same or different and each represents a hydrogen atom, an alkyl group (preferably having from 1 to 12 carbon atoms), an alkenyl group (preferably having from 2 to 12 carbon atoms), or an aryl group (preferably having from 6 to 12 carbon atoms); B represents an atomic group necessary to form a substituted or unsubstituted 5-membered or 6-membered ring; m and n each represents 0 or 1; and (n+m) is 1 or 2.

In formula (b), the 5-membered or 6-membered ring formed by B includes, for example, cyclohexene, cycloheptene, benzene, naphthalene, pyridine, and quinoline rings.

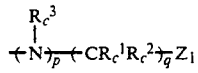

(c)

wherein $Z_1$ is as defined above; $R_c^1$ and $R_c^2$ may be the same or different and each represents a hydrogen atom, an alkyl group, an alkenyl group, an aryl group, or a halogen atom; $R_c^3$ represents a hydrogen atom, an alkyl group, an alkenyl group, or an aryl group; p represents 0 or 1; q represents an integer of from 1 to 4; $R_c^1$, $R_c^2$, and $R_c^3$ may together form a ring as long as $Z_1$ is capable of intramolecular nucleophilic attack on $G_1$.

$R_c^1$ and $R_c^2$ each preferably represent a hydrogen atom, a halogen atom, or an alkyl group, and $R_c^3$ preferably represents an alkyl group or an aryl group.

q preferably represents 1 to 3. When q is 1, p represents 0 or 1; when q is 2, p represents 0 or 1; when q is 3, p represents 0 or 1; and when q is 2 or 3, $R_c^1$ and $R_c^2$ may be the same or different.

In formula (II), $A_1$ and $A_2$ each represent a hydrogen atom; an alkylsulfonyl or arylsulfonyl group having not more than 20 carbon atoms (preferably a phenylsulfonyl group or a phenylsulfonyl group which is substituted so that the sum of the Hammett constants is −0.5 or more); an acyl group having not more than 20 carbon atoms (preferably a benzoyl group; a benzoyl group which is substituted so that the sum of the Hammett substituent constants is −0.5 or more, or a straight chain, branched or cyclic, substituted or unsubstituted aliphatic acyl group (substituents include a halogen atom, an ether group, a sulfonamido group, a carbonamido group, a hydroxy group, a carboxy group, and a sulfo group)).

$A_1$ and $A_2$ each preferably represent a hydrogen atom.

$R_1$ or $R_2$ in formula (II) may contain a ballast group of the type commonly employed in immobile photographic additives such as couplers or may form a polymer. The ballast group is a group which contains at least 8 carbon atoms and is relatively inert in terms of photographic characteristics. Suitable examples of ballast groups are an alkyl group, an alkoxy group, a phenyl group, an alkylphenyl group, a phenoxy group, and an alkylphenoxy group. Suitable examples of the polymers are described in JP-A-1-100530.

$R_1$ or $R_2$ in formula (II) may also contain a group which accelerates adsorption onto the surfaces of silver halide grains (hereinafter referred to as an adsorption accelerating group). Examples of such adsorption accelerating groups are a thiourea group, a heterocyclic thioamido group, a mercapto heterocyclic group, and a triazole group as described in U.S. Pat. Nos. 4,385,108 and 4,459,347; JP-A-59-195233; JP-A-59-200231; JP-A-59-201045; JP-A-59-201046; JP-A-59-201047; JP-A-59-201048; JP-A-59-201049; JP-A-61-170733; JP-A-61-270744; JP-A-62-948; JP-A-63-234244; JP-A-63-234245; and JP-A-63-234246).

Specific examples of the hydrazine derivative represented by formula (II) are set forth below, but the present invention should not be construed as being limited thereto.

II-1)

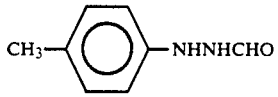

II-2)

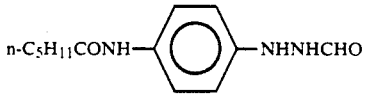

II-3)

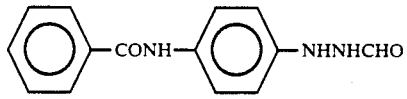

II-4)

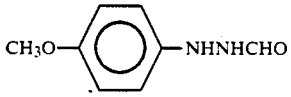

II-5)

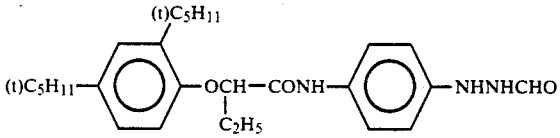

II-6)

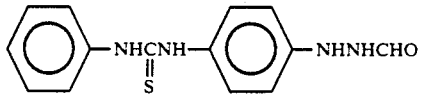

II-7)

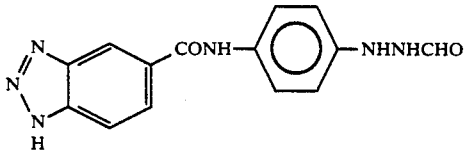

II-8)

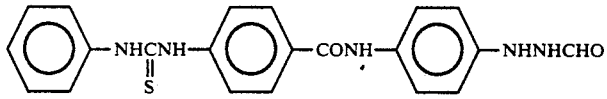

II-9)

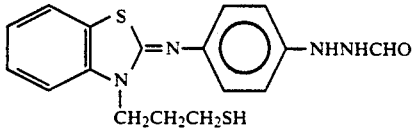

-continued
-II-10)
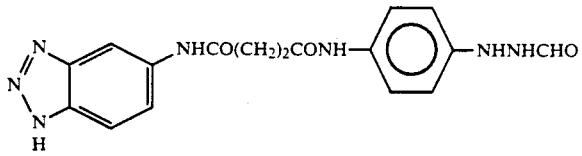
II-11)
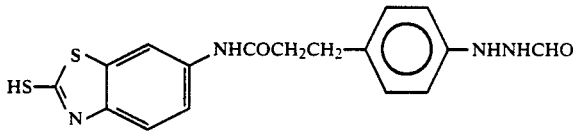
II-12)
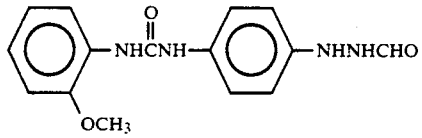
II-13)
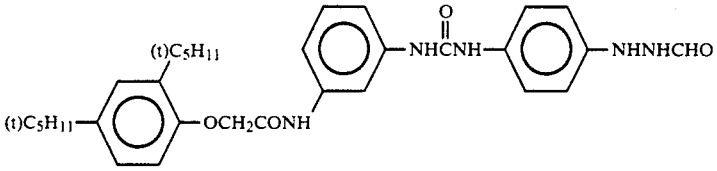
II-14)
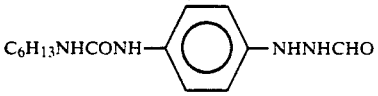
II-15)
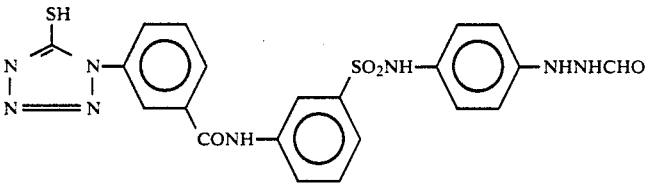
II-16)
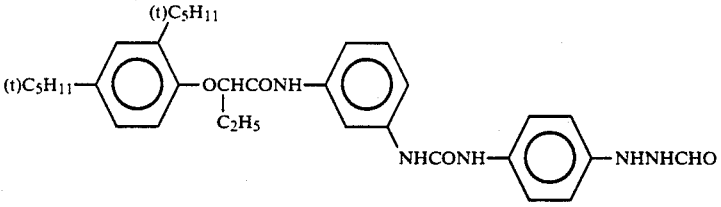
II-17)
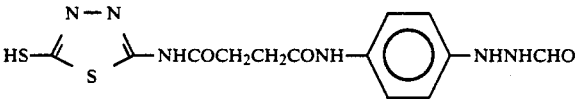
II-18)
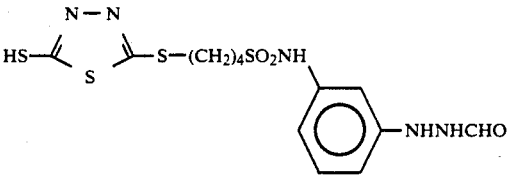

-continued
II-19)
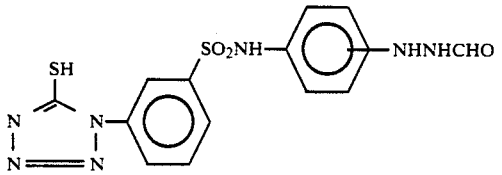
II-20)
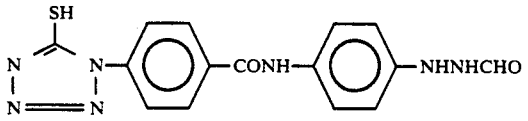
II-21)
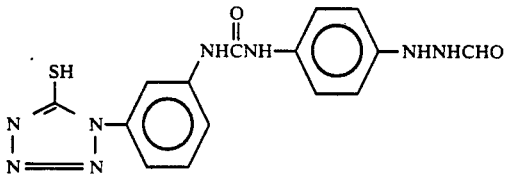
II-22)
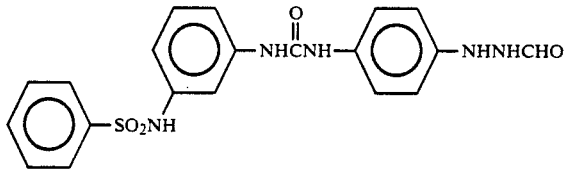
II-23)
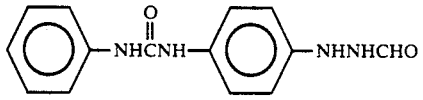
II-24)
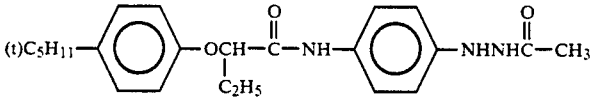
II-25)
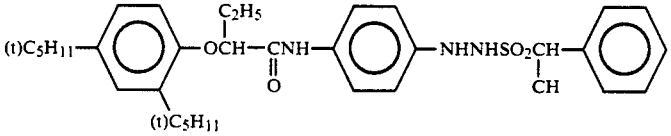
II-26)
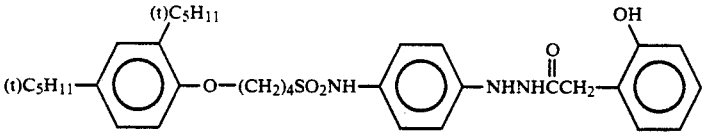
II-27)
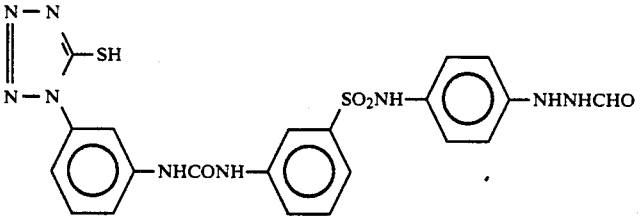
II-28)
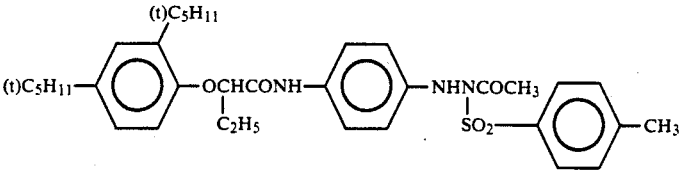

-continued
II-29)
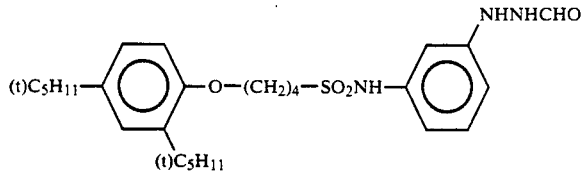
II-30)
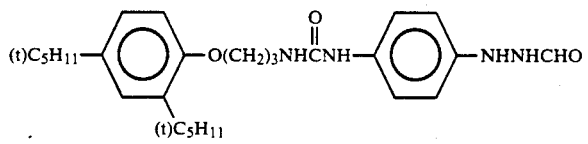
II-31)
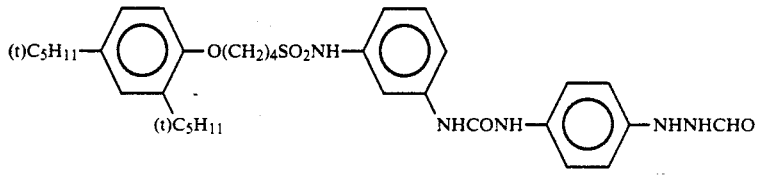
II-32)
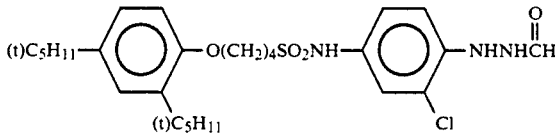
II-33)
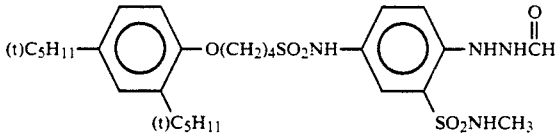
II-34)
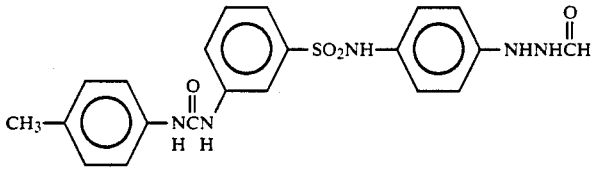
II-35)
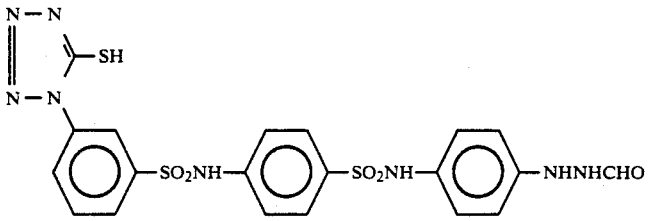
II-36)
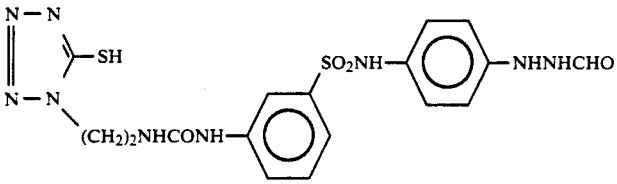

-continued
II-37)
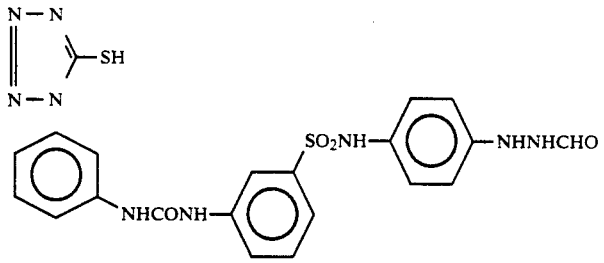
II-38)
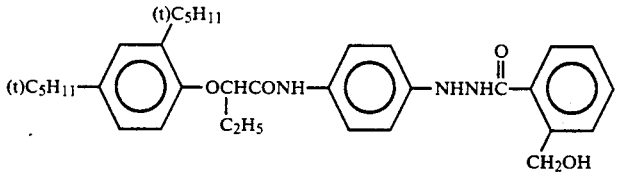
II-39)
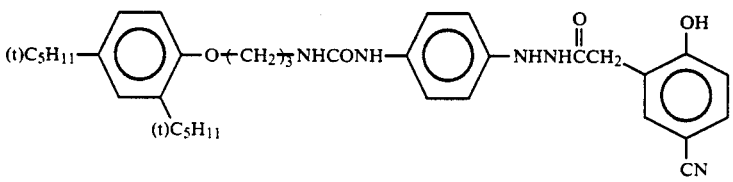
II-40)
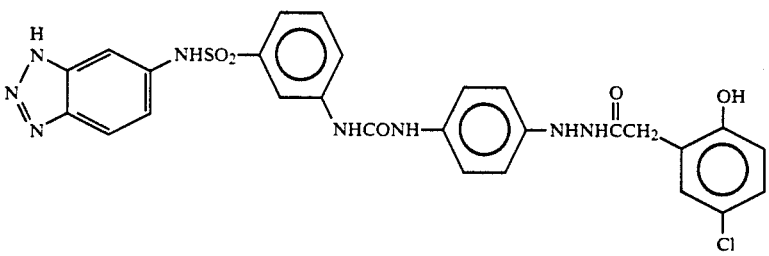
II-41)
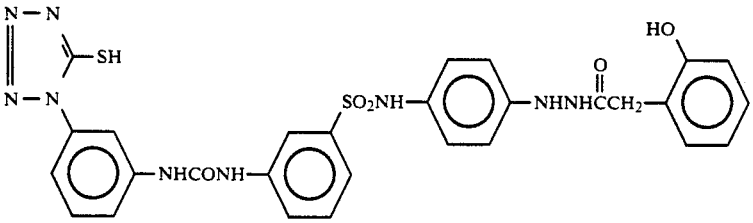
II-42)
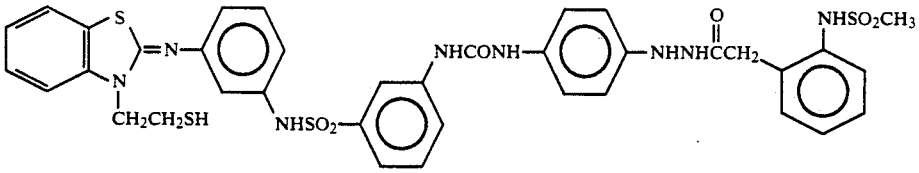
II-43)
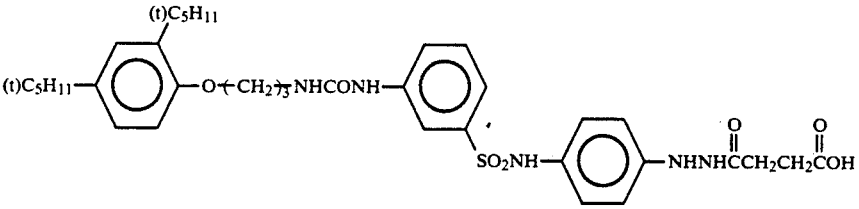
II-44)
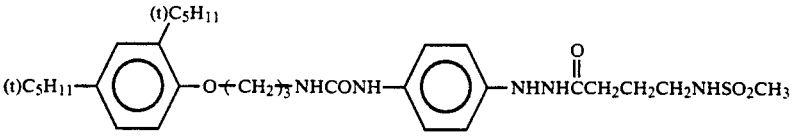

-continued
II-45)
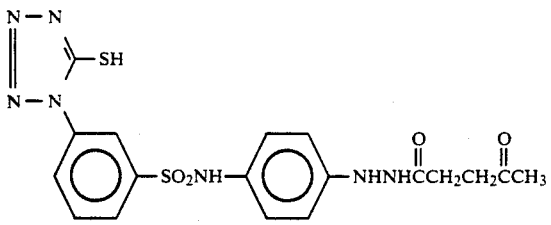
II-46)
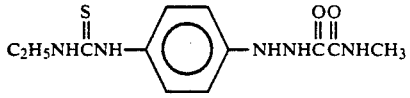
II-47)
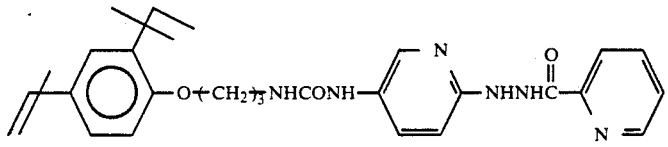
II-48)
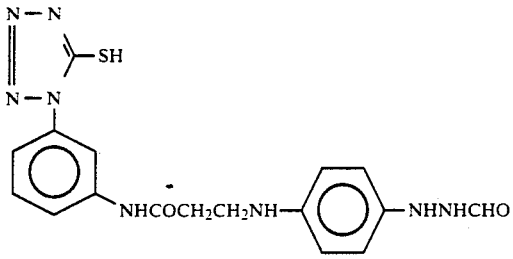
II-49)
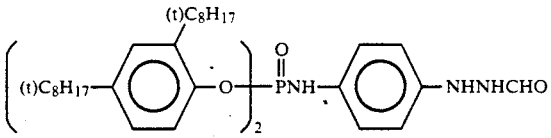
II-50)
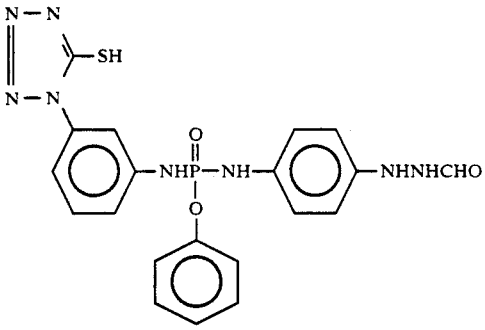
II-51)
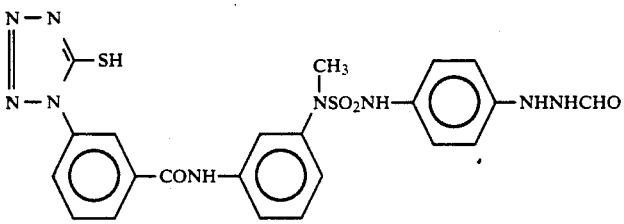
II-52)
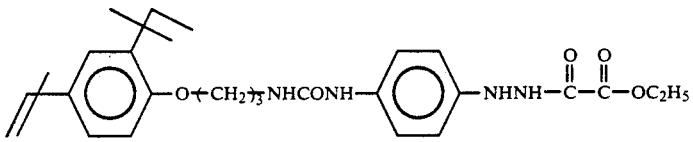

-continued

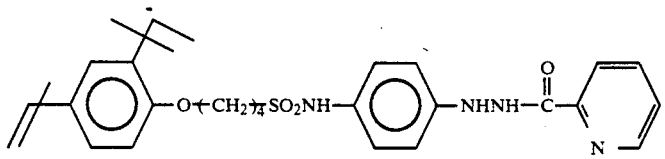

II-53)

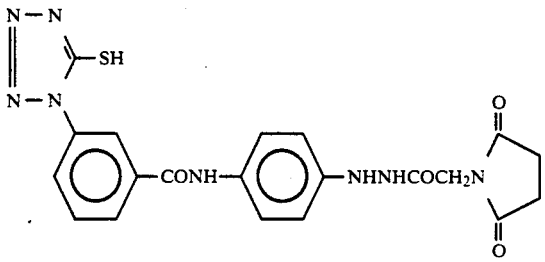

II-54)

In addition to the above compounds, it is also possible to use the hydrazine derivatives described and referenced in *Research Disclosure,* No. 23516 (November, 1983), page 346; and those described in U.S. Pat. Nos. 4,080,207, 4,269,929, 4,276,364, 4,278,748, 4,385,108, 4,459,347, 4,560,638 and 4,478,928; British Patent 2,011,391B; JP-A-60-179734; JP-A-62-270948; JP-A-63-29751; JP-A-61-170733; JP-A-61-270744; JP-A-62-948; European Patent 217,310; U.S. Pat. No. 4,686,167; JP-A-62-178246; JP-A-63-32538; JP-A-63-104047; JP-A-63-121838; JP-A-63-129337; JP-A-63-223744; JP-A-63-234245; JP-A-63-234246; JP-A-63-294552; JP-A-63-3-6438; JP-A-1-100530; JP-A-1-105941; JP-A-1-105943; JP-A-64-10233; JP-A-1-90439; JP-A-1-276128; JP-A-283548; JP-A-1-280747; JP-A-1-283549; JP-A-1-285940; and Japanese Patent Application Nos. 63-147339, 63-179760, 63-229163, 1-18377, 1-18378, 1-18379, 1-15755, 1-16814, 1-40792, 1-42615, 1-42616, 1-123693 and 1-126284.

The amount of the hydrazine derivative employed in the present invention is preferably from about $1\times10^{-6}$ mol to about $5\times10^{-2}$ mol; most preferably from about $1\times10^{-5}$ mol to about $2\times10^{-2}$ mol, per mol of silver halide.

The developing agent used in the present invention is incorporated, at least, into the at least one silver halide emulsion layer or the hydrophilic colloid layer. Useful developing agents are dihydroxybenzene (for example, hydroquinone, chlorohydroquinone, bromohydroquinone, isopropylhydroquinone, methylhydroquinone, 2,3-dichlorohydroquinone, 2,5-dimethylhydroquinone, or tert-butylhydroquinone); 3-pyrazolidone (for example, 1-phenyl-3-pyrazolidone); and aminophenol (for example, N-methyl-p-aminophenol). These can be employed individually or in combinations. Among these, hydroquinones are preferred.

In order to incorporate the developing agent into the silver halide photographic material, any known method can be employed. For example, the developing agent can be dissolved in an organic solvent which is miscible with water and does not adversely affect photographic properties (such as an alcohol, a glycol, a ketone, an ester, or an amide), and the resulting solution added to at least one of coating solutions for the silver halide emulsion layer or the hydrophilic colloid layer. The developing agent can be added as a dispersion in oil to an emulsion as described in JP-A-50-39928. The developing agent can be dissolved in an aqueous gelatin solution, and the resulting solution added to an appropriate coating solution. The developing agent can also be dispersed in a polymer (such as an alkyl acrylate, an alkyl methacrylate, or a cellulose ester) and the dispersion added to an appropriate coating solution as described in JP-B-45-15461.

The amount of developing agent incorporated into the silver halide photographic material is generally from about 0.05 mol to about 5 mol; preferably from about 0.2 mol to about 3 mol, per mol of silver halide.

The silver halide emulsions used in the present invention may be of any composition, such as silver chloride, silver chlorobromide, silver iodobromide, or silver iodochlorobromide.

The average grain size of the silver halide used in the present invention is preferably very fine (for example, not more than 0.7 $\mu$). A grain size of not more than 0.5 $\mu$ is most desirable. Fundamentally, no limitation is imposed upon the grain size distribution, but the use of monodispersions is preferred. Here, the term "monodispersion" signifies that the emulsion is comprised of grains such that at least 95% of the grains in terms of the number of grains or total weight of the grains are sized within $\pm40\%$ of the average grain size.

The silver halide grains in the photographic emulsion may have a regular crystalline form such as a cubic or octahedral form; they may have an irregular form such as a spherical or plate-like form; or they may be a composite of regular and irregular forms.

The silver halide grains may be such that the interior and surface layer are comprised of a uniform phase, or the interior and surface layer may be comprised of different phases. Mixtures of two or more types of silver halide emulsion which have been prepared separately can also be used.

Cadmium salts, sulfites, lead salts, thallium salts, rhodium salts, complex rhodium salts, iridium salts, or complex iridium salts may also be present during the formation or physical ripening processes of the silver halide grains in the silver halide emulsions used in the present invention.

Water soluble dyes can be included in the emulsion layers or other hydrophilic colloid layers in the present invention as filter dyes, for the prevention of irradiation or for other purposes. Dyes for further reducing photographic speed; ultraviolet light absorbers (that have a spectral absorption peak in the intrinsically sensitive region of silver halides); and dyes that absorb light principally within the 350 nm -600 nm range (that increase stability with respect to safe-light when light-sensitive materials are being handled as light-room light-sensitive materials) can be used as filter dyes.

These dyes may be added to the emulsion layer or they may be added together with a mordant to the at least one light-insensitive hydrophilic colloid layer above the silver halide emulsion layer, which is to say, which is further from the support than the silver halide emulsion layer, and fixed in this layer, depending on the intended purpose of the dye.

The precise amount of a dye added depends on the molecular extinction coefficient of the dye, but is normally from about $10^{-2}$ g/m$^2$ to 1 g/m$^2$, and preferably from about 50 mg/m$^2$ to about 500 mg/m$^2$.

Specific examples of such dyes are described in detail in JP-A-63-64039, and some are illustrated below.

D-1

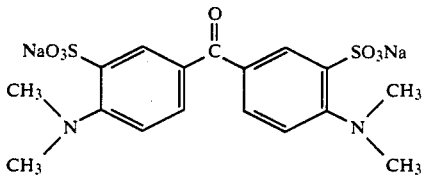

D-2

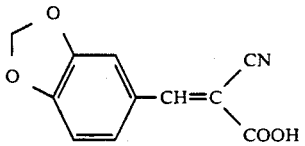

D-3

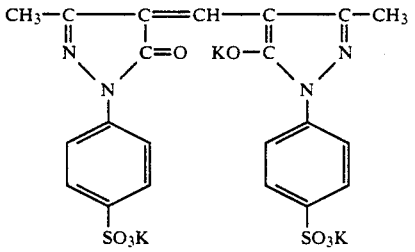

D-4

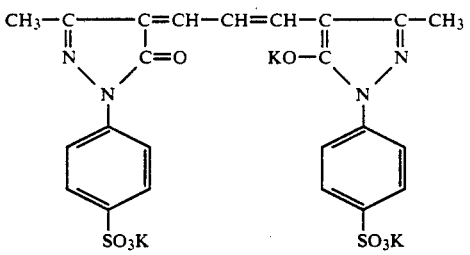

D-5

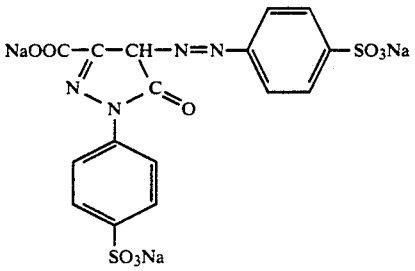

-continued

D-6

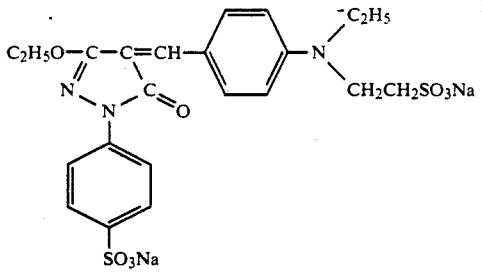

The above described dyes are dissolved in a suitable solvent (for example, water; an alcohol like methanol, ethanol, or propanol; acetone; methylcellosolve; or a mixture of such solvents) and added to the coating solution used for a light-insensitive hydrophilic colloid layer.

Two or more of these dyes may also be employed together.

The dye is used in the amount necessary to make it possible to handle the light-sensitive material handling in a light room. More specifically, the amount of dye used is preferably from about $1\times10^{-3}$ g/m$^2$ to about 1 g/m$^2$; most preferably from about $1\times10^{-3}$ g/m$^2$ to about 0.5 g/m$^2$.

Gelatin is advantageously employed as a binder or a protective colloid in the photographic emulsions of the invention. Other hydrophilic colloids may also be used. Examples of usable hydrophilic colloids include proteins (e.g., gelatin derivatives, graft polymers of gelatin with other polymers, albumin, and casein); cellulose derivatives (e.g., hydroxyethyl cellulose, carboxymethyl cellulose, and cellulose sulfate); sugar derivatives (e.g., sodium alginate, and starch derivatives); and a wide variety of synthetic hydrophilic high-molecular substances (e.g., polyvinyl alcohol, polyvinyl alcohol partial acetal, poly-N-vinylpyrrolidone, polyacrylic acid, polymethacrylate acid, polyacrylamide, polyvinylimidazole, polyvinylpyrazole, and copolymers formed from the monomers of these homopolymers).

The gelatin used can be lime-processed gelatin, acid-processed gelatin, hydrolysis products of gelatin, and enzymatic decomposition products of gelatin.

The silver halide emulsion used in the present invention may or may not be subjected to chemical sensitization. Sulfur sensitization, reduction sensitization and noble metal sensitization are useful chemical sensitization methods. These methods can be used individually or in combination.

Gold sensitization using gold complex salts and sensitization using complex salts of noble metals other than gold, such as platinum, palladium or iridium can be used. Specific examples of these are given in U.S. Pat. No. 2,448,060 and British Patent 618,061.

In addition to the sulfur compounds that are contained in gelatin, various sulfur compounds, for example, thiosulfates, thioureas, thiazoles, and rhodanines can be used as sulfur sensitizing agents.

Stannous salts, amines, formamidinsulfinic acid, and silane compounds can be used as reducing sensitizing agents.

Known spectral sensitizing dyes added to the silver halide emulsion layer can be used in the present invention.

Various compounds can be incorporated into the photographic materials of the present invention for the purpose of preventing the occurrence of fog during the manufacture; storage or photographic processing of the light-sensitive material; or stabilization of other photographic properties. Thus, known anti-fogging agents or stabilizers, such as azoles (for example, benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, or nitrobenzotriazoles); mercaptopyrimidines; mercaptotriazines; thioketo compounds (such as oxazolinethione); azaindenes (for example triazaindenes, tetraazaindenes (especially 4-hydroxy substituted (1,3,3a,7)tetraazaindenes), and pentaazaindenes); benzenethiosulfonic acid; benzenesulfinic acid; and benzenesulfonic acid amide, can be used. Among these compounds, the benzotriazoles (for example, 5-methylbenzotriazole) and nitroindazoles (for example, 5-nitroindazole) are preferred. Furthermore, these compounds may be included in a processing solution.

Inorganic or organic hardening agents can be incorporated into the photographic emulsion layer or other hydrophilic colloid layers in the photographic light-sensitive materials of the present invention. For example, chromium salts (for example, chromium alum); aldehydes (for example, glutaraldehyde); N-methylol compounds (for example, dimethylolurea); dioxane derivatives; active vinyl compounds (for example, 1,3,5-triacryloylhexahydo-s-triazine, or 1,3-vinylsulfonyl-2-propanol); active halogen compounds (for example, 2,4-dichloro-6-hydroxy-s-triazine); and mucohalogen acids can be used individually or in combination.

A variety of surfactants can be included in the photographic emulsion layer or other hydrophilic colloid layers of the photographic material of the present invention for various purposes, for example, as coating aids, as antistatic agents, for improving slip properties, for emulsification and dispersion purposes, for the prevention of adhesions, or for improving photographic performance (for example, accelerating development, increasing contrast or increasing speed).

For example, nonionic surfactants, such as saponin (steroid based); alkylene oxide derivatives (for example, polyethylene glycol, polyethylene glycol/polypropylene glycol condensates, polyethylene glycol alkyl ethers or polyethylene glycol alkyl aryl ethers, polyethylene glycol esters, polyethylene glycol sorbitan esters, polyalkylene glycol alkyl amines or amides, and polyethylene oxide adducts of silicones); glycidol derivatives (for example, alkenylsuccinic acid polyglyceride, and alkylphenol polyglyceride); fatty acid esters of polyhydric alcohols; and sugar alkyl esters can be used.

Anionic surfactants, which include acidic groups, such as carboxy groups; sulfo groups; phospho groups; sulfate groups; and phosphate groups (for example, alkylcarboxylates, alkylsulfonates alkylbenzenesulfonates, alkylnaphthalenesulfonates, alkylsulfate, alkylphosphate, N-acyl-N-alkyltaurines, sulfosuccinate, sulfoalkylpolyoxyethylene alkylphenyl ethers, and polyoxyethylene alkylphosphate) can be used.

Amphoteric surfactants, such as amino acids; aminoalkylsulfonic acid; aminoalkyl sulfate or phosphate; alkylbetaines; and amineoxides can be used.

Cationic surfactants, such as alkylamine salts; aliphatic and aromatic quaternary ammonium salts; heterocyclic quaternary ammonium salts (for example pyridinium salts and imidazolium salts); and phosphonium salts and sulfonium salts which contain aliphatic or heterocyclic rings can be used.

The polyalkylene oxides of a molecular weight of at least 600 as described in JP-B-58-9412 are especially desirable surfactants for use in the present invention. Furthermore, polymer latexes, such as polyalkyl acrylate latexes, can be included to provide dimensional stability.

The compounds described, for example, in JP-A-53-77616, JP-A-54-37732, JP-A-53-137133, JP-A-60-140340 and JP-A-60-14959; various compounds which contain an N or S atom effective as development accelerators; and nucleation infectious development accelerators can be used in the present invention.

Specific examples of these are illustrated below.

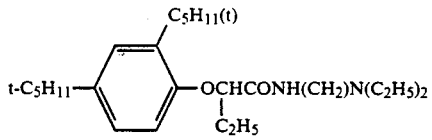

A-1

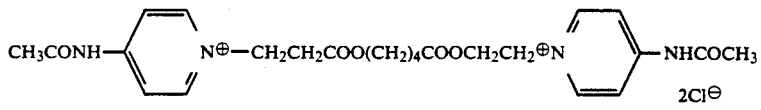

A-2

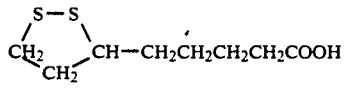

A-3

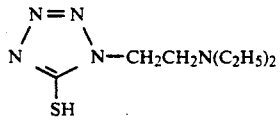

A-4

-continued
A-5
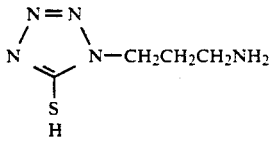
A-6
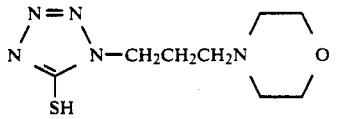
A-7
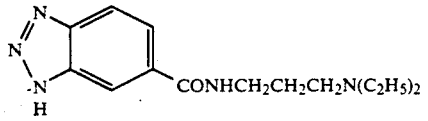
A-8
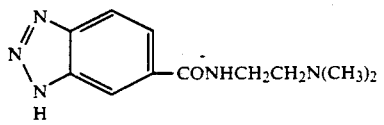
A-9
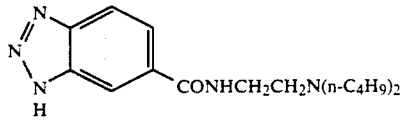
A-10
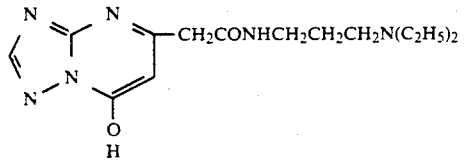
A-11
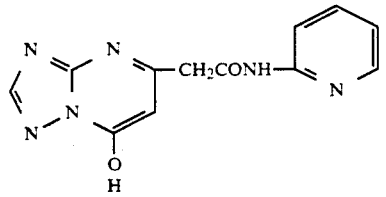
A-12
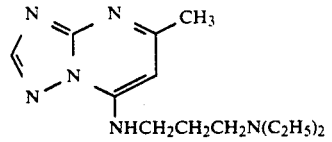
A-13
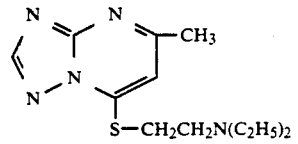
A-14
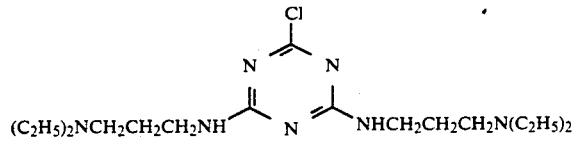
A-15
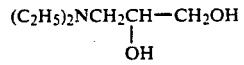

-continued

| | |
|---|---|
| $n\text{-}C_4H_9N(C_2H_4OH)_1$ | A-16 |

The precise amount of the accelerator added differs depending on the type of compound. Generally the amount added ranges from about $1.0\times10^{-3}$ g/m$^2$ to about 0.5 g/m$^2$; preferably from about $5.0\times10^{-3}$ g/m$^2$ to about 0.1 g/m$^2$. The accelerator is dissolved in a suitable solvent (for example, water; an alcohol such as methanol and ethanol; acetone; dimethylformamide; or methylcellosolve) and added to the coating solutions.

A plurality of these additives can be used together.

A stable developing solution can be used to obtain ultrahigh contrast photographic characteristics with the silver halide photographic material of the present invention, and there is no need for the use of conventional infectious developing solutions or highly alkaline developing solutions having a pH near 13 as described in U.S. Pat. No. 2,419,975.

That is to say, ultrahigh contrast negative images can be obtained satisfactorily with the silver halide photographic material of the present invention using a developing solutions of about pH 10.5–12.3; preferably of about pH 11.0–12.0, that contain at least 0.15 mol/liter of sulfite ion as a preservative.

No particular limitation is imposed upon the developing agents used in the method of the present invention. For example, dihydroxybenzenes (for example, hydroquinone), 3-pyrazolidones (for example, 1-phenyl-3-pyrazolidone, or 4,4-dimethyl-1-phenyl-3-pyrazolidone), and aminophenols (for example, N-methyl-p-aminophenol) can be employed either individually or in combination.

The silver halide photographic material of the present invention is especially suitable for processing in developing solution that contains a dihydroxybenzene as the main developing agent and a 3-pyrazolidone or an aminophenol as an auxiliary developing agent. The combined use of from 0.05 to 0.5 mol/liter of a dihydroxybenzene and not more than 0.06 mol/liter of a 3-pyrazolidone or aminophenol in the developing solution is preferred.

The development rate can be increased and the development time shortened by adding amines to the developing solution, as described in U.S. Pat. No. 4,269,929.

The developing solution may contain pH buffers (such as alkali metal sulfite carbonates, borates, and phosphates); development inhibitors or antifoggants (such as bromides and iodides); and organic antifoggants (nitroindazoles and benzotriazoles being especially preferred). Water softening agents, dissolution promotors, toning agents, development accelerators, surfactants (the above described polyalkylene oxides being especially preferred), defoaming agents, hardening agents, and agents for preventing silver contamination of film (for example, 2-mercaptobenzimidazolesulfonic acid) can also be included.

Fixing solution of thiosulfates, thiocyanates, and organosulfur compounds can be used. Water soluble aluminum salts can be included in these fixing solutions as hardening agents.

The processing temperature in the method of the present invention is normally from 18° C. to 50° C.

The use of an automatic processor is preferred for photographic processing. Ultrahigh contrast negative gradation photographic characteristics can be obtained using the method of the present invention even if the total processing time from the introduction of the light-sensitive material into the processor to removing the material from the processor is from 90 to 120 seconds.

The compounds as described in JP-A-56-24347 can be used in the developing solution used in the present invention as agents for preventing silver contamination.

The compounds as described in JP-A-61-267759 can be used as dissolution promotors when they are added to the developing solution.

The compounds described in JP-A-60-93433 and Japanese Patent Application No. 60-93433 can be used as pH buffers in the developing solution.

The present invention is now illustrated in greater detail with reference to the following examples, but the present invention is not to be construed as being limited thereto. Unless otherwise indicated, all measurements, percentages, and ratios are by weight.

COMPARATIVE EXAMPLE 1

Preparation of Light-Sensitive Emulsion

An aqueous solution of silver nitrate and an aqueous solution of potassium iodide and potassium bromide were added simultaneously over a period of 60 minutes to an aqueous gelatin solution at 50° C. that contained $4\times10^{-7}$ mol/mol Ag of potassium hexachloroiridium(III) and ammonia. The pAg was maintained at 7.8 as the aqueous solutions were added. A cubic monodispersed emulsion having an average grain size of 0.28 μm and an average silver iodide content of 0.3 mol % was obtained. After desalting the emulsion using a flocculation method, 40 grams of inert gelatin was added per mol of silver. Then, 5,5'-dichloro-9-ethyl-3,3'-bis(3-sulfopropyl)oxacarbocyanine as sensitizing dye and a solution of $10^{-3}$ mol per mol of silver of KI were added while the emulsion was maintained at 50° C. The temperature was dropped after ageing for 15 minutes.

Coating of Light-Sensitive Emulsion Layer

The emulsion prepared above was re-melted, and the hydrazine derivative described below added at 40° C.

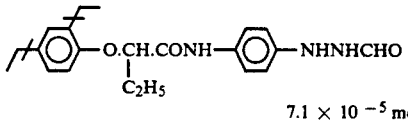

$7.1\times10^{-5}$ mol/m$^2$

5-Methylbenzotriazole, 4-hydroxy-1,3,3a,7-tetraazaindene; Compounds (a) and (b), described below; 30 wt % with respect to gelatin of polyethyl acrylate; and Compound (c), described below, as a gelatin hardener were added, and the mixture was coated in an amount of 3.4 g/m$^2$ on a polyethylene terephthalate film (thickness: 150 μm having a subbing layer of 0.5 μm thick of vinylidene chloride).

Compound (a)

-continued

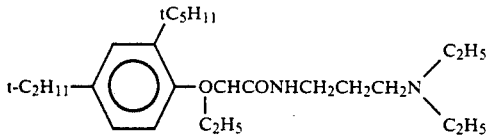

3.5 mg/m²

Compound (b)

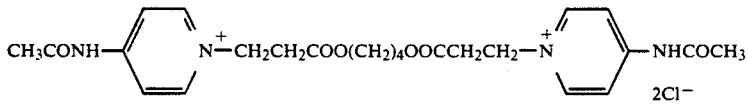

15.0 mg/m²

Compound (c)

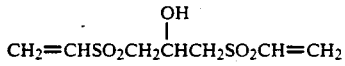

2.0 wt % with respect to gelatin

Coating of Protective Layer

A protective layer comprising 1.5 g/m² of gelatin and 0.3 g/m² of polymethyl methacrylate particles (average particle size: 2.5 μm) was coated on the emulsion layer using the surfactants described below to produce Comparative Example 1.

| Surfactants | |
|---|---|
| 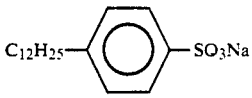 | 37 mg/m² |
| $CH_2COOC_6H_{13}$<br>\|<br>$CHCOOC_6H_{13}$<br>\|<br>$SO_3Na$ | 37 mg/m² |
| $C_8F_{17}SO_2N(C_3H_7)CH_2COOK$ | 2.5 mg/m² |

COMPARATIVE EXAMPLES 2 AND 3

The same procedures described in Comparative Example 1 were repeated except that $2.0\times10^{-5}$ mol/m² of Redox Compound 17 and $2.0\times10^{-5}$ mol/m² of Redox Compound 34 were added to the light-sensitive emulsion layer.

COMPARATIVE EXAMPLES 4, 5 AND 6

The same procedures described in Comparative Example 1 were repeated except that a gelatin underlayer containing gelatin (1.5 g/m²), a light-sensitive silver halide emulsion (same emulsions as used in Comparative Example 1) (0.3 g/m² in terms of silver) and Redox Compounds 17, 34 and 38 ($2.0\times10^{-5}$ mol/m² of each) were added between the support and the light-sensitive emulsion layer, respectively.

EXAMPLE 1

Samples were prepared as described in Comparative Examples 4, 5 and 6 except that 100 mg/m² of hydroquinone or 10 mg/m² of 1-phenyl-3-pyrazolidone was added to the gelatin underlayer.

These samples were exposed through a contact screen (150L chain dot type, manufactured by Fuji Photo Film Co., Ltd.) and an optical wedge using tungsten light of color temperature 3200° K. They were developed for 30 seconds at 34° C. in the developing solution described below, fixed, washed and dried.

The results obtained on measuring the dot gradation of the samples are shown in Table 1. The dot gradation was expressed by the following equation:

Dot Gradation ($\Delta\log E$) = Exposure amount providing a dot area ratio of 95% ($\log E_{95\%}$) − Exposure amount providing a dot area ratio of 5% ($\log E_{5\%}$)

Table 1 shows that the samples prepared according to the present invention provide a very broad dot gradation compared to the comparative samples. In Comparative Examples 2 and 3, the high contrast property is damaged, reducing $\overline{G}$less than 10.

The shape of dot is irregular in Comparative Example 1. The optical density of dot is low and dot is blurred in Comparative Examples 2 and 3. In Comparative Examples 4,5 and 6, smoothness of the dot is insufficient. In contrast, the samples of the present invention provide dots having smooth shape and high optical density.

| Developing Solution | |
|---|---|
| Hydroquinone | 50.0 g |
| N-Methyl-p-aminophenol | 0.3 g |
| Sodium hydroxide | 18.0 g |
| 5-Sulfosalicylic acid | 55.0 g |
| Potassium sulfite | 110.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)benzenesulfonate | 0.2 g |
| N-n-Butyldiethanolamine | 15.0 g |
| Sodium toluenesulfonate | 8.0 g |
| Water to make | 1 l |
| pH adjusted to 11.6 (by adding potassium hydroxide) | pH 11.6 |

TABLE 1

| No. | Sample | Redox Compound Type | Redox Compound Layer Added | Developing agent | Photographic Property $\bar{G}$ | Photographic Property Dot Gradation |
|---|---|---|---|---|---|---|
| 1 | Comparative Example 1 | — | — | — | 14.5 | 1.23 |
| 2 | Comparative Example 2 | Compound 17 | Light-Sensitive Emulsion Layer | — | 8.3 | 1.38 |
| 3 | Comparative Example 3 | Compound 34 | Light-Sensitive Emulsion Layer | — | 7.9 | 1.40 |
| 4 | Comparative Example 4 | Compound 17 | Gelatin Underlayer | — | 14.0 | 1.45 |
| 5 | Comparative Example 5 | Compound 34 | Gelatin Underlayer | — | 14.5 | 1.48 |
| 6 | Comparative Example 6 | Compound 38 | Gelatin Underlayer | — | 13.5 | 1.43 |
| 7 | Example 1-1 | Compound 17 | Gelatin Underlayer | Hydroquinone | 14.5 | 1.48 |
| 8 | Example 1-2 | Compound 34 | Gelatin Underlayer | Hydroquinone | 15.0 | 1.50 |
| 9 | Example 1-3 | Compound 38 | Gelatin Underlayer | Hydroquinone | 14.5 | 1.45 |
| 10 | Example 1-4 | Compound 17 | Gelatin Underlayer | 1-Phenyl-3-pyrazolidone | 14.5 | 1.48 |
| 11 | Example 1-5 | Compound 34 | Gelatin Underlayer | 1-Phenyl-3-pyrazolidone | 15.0 | 1.50 |
| 12 | Example 1-6 | Compound 38 | Gelatin Underlayer | 1-Phenyl-3-pyrazolidone | 14.5 | 1.46 |

EXAMPLE 2

On a polyester film support (thickness: 150 μm), the following layers were coated to prepare the samples shown in Table 2, below:

1. Light-Sensitive Emulsion Layer A

The light-sensitive emulsion described in Comparative Example 1 above was coated using 0.48 g/m$^2$ of silver coating. The developing agent was coated.

2. Intermediate Layer

| | |
|---|---|
| Gelatin | 0.5 g/m$^2$ |
| Polyethyl Acrylate Latex | 0.15 |
| Redox Compound of the present invention | (shown in Table 2) |

3. Intermediate Layer

| | |
|---|---|
| Gelatin | 0.5 g/m$^2$ |

4. Light-Sensitive Emulsion Layer B

The light-sensitive emulsion described in Comparative Example 1, above, was coated with 3.4 g/m$^2$ of silver coating.

The samples were evaluated in the same manner as in Example 1. The results obtained are shown in Table 2 below.

TABLE 2

| No. | Sample | Redox Compound Type | Redox Compound Amount Added (mol/m$^2$) | Developing Agent Type | Developing Agent Amount Added (mol/m$^2$) | Dot Gradation | Dot Quality |
|---|---|---|---|---|---|---|---|
| 1 | Comparative Example 7 | — | — | — | — | 1.19 | 3 |
| 2 | Comparative Example 8 | Compound 17 | $2.1 \times 10^{-5}$ | — | — | 1.39 | 4 |
| 3 | Comparative Example 9 | Compound 37 | $2.1 \times 10^{-5}$ | — | — | 1.42 | 4 |
| 4 | Comparative Example 10 | Compound 38 | $2.1 \times 10^{-5}$ | — | — | 1.41 | 4 |
| 5 | Comparative Example 11 | Compound 19 | $2.1 \times 10^{-5}$ | — | — | 1.43 | 4 |
| 6 | Example 2-1 | Compound 17 | $2.1 \times 10^{-5}$ | 1-Phenyl-3-pyrazolidone | 10.0 | 1.43 | 4.5 |
| 7 | Example 2-2 | Compound 37 | $2.1 \times 10^{-5}$ | 1-Phenyl-3-pyrazolidone | 10.0 | 1.45 | 4.5 |
| 8 | Example 2-3 | Compound 38 | $2.1 \times 10^{-5}$ | 1-Phenyl-3-pyrazolidone | 10.0 | 1.43 | 4.5 |
| 9 | Example 2-4 | Compound 19 | $2.1 \times 10^{-5}$ | 1-Phenyl-3-pyrazolidone | 10.0 | 1.45 | 4.5 |

The dot quality was assessed visually in five ranks. The rank "5" indicates the best quality and the rank "1" indicates the worst quality. Those giving the ranks "5" and "4" can be used as dot originals for plate making, those giving the rank "3" are on the limit for practical use, and those giving the ranks "2" and "1" are of no practical use.

As is apparent from Table 2, the samples according to the present invention exhibit high dot quality and provide dot images of broad dot gradation.

EXAMPLE 3

An aqueous solution of silver nitrate and an aqueous solution of sodium chloride were added simultaneously to an aqueous gelatin solution maintained at 50° C. in the presence of $5.0\times10^{-6}$ mol/mol Ag of $(NH_4)_3RhCl_6$. After removing soluble salts, gelatin was added to the emulsion. As a stabilizer, 2-methyl-4-hydroxy-1,3,3a,7-tetraazaindene was added to the emulsion without conducting chemical sensitization. Thus, a cubic monodispersed emulsion having an average grain size of 0.15 μm was obtained (Emulsion B).

To Emulsion B was added the following hydrazine derivative.

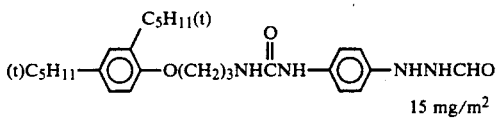

15 mg/m²

Further, the redox compound and developing agent of the present invention as shown in Table 3 below were also added. Then 1,3-divinylsulfonyl-2-propanol was added as a hardening agent, and the mixture was coated on a polyester film in an amount of 0.4 g/m² in terms of silver. The coating amount of gelatin was 0.5 g/m².

On the emulsion layer was coated an intermediate layer in a gelatin coating amount of 0.5 g/m².

Separately and in order, to Emulsion B were added, the hydrazine derivative described below; 30 wt % (solid base) with respect to gelatin of polyethyl acrylate latex; and 2.0 wt % with respect to gelatin of 1,3-divinylsulfonyl-2-propanol as a hardening agent The resulting mixture was coated on the intermediate layer in an amount of 3.4 g/m² in terms of silver.

On the emulsion layer were coated and dried a protective layer containing 1.5 g/m² of gelatin; 0.3 g/m² of polymethyl methacrylate particles (average particle size: 2.5 μm) as a matting agent; and the surfactants as coating aids, stabilizer and ultraviolet absorbing dye described below.

Surfactants

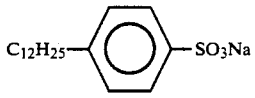

37 mg/m²

$CH_2COOC_6H_{13}$
|
$CHCOOC_6H_{13}$
|
$SO_3Na$ 37 mg/m²

$C_8F_{17}SO_2N(C_3H_7)CH_2COOK$ 2.5 mg/m²

Stabilizer
Thioctic acid 2.1 mg/m²

Ultraviolet Absorbing Dye

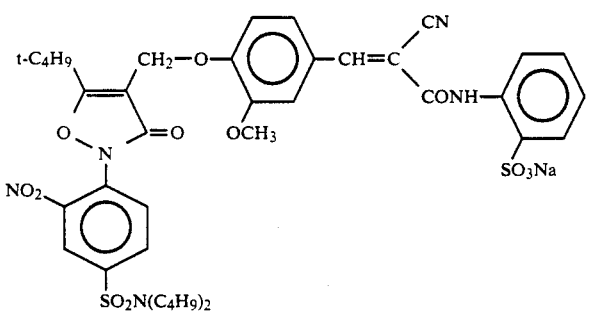

100 mg/m²

Each of these samples was exposed to light through the original using a light room type printer, P-607 manufactured by Dainippon Screen Mfg. Co., Ltd. in the configuration illustrated in FIG. 1, developed at 38° C. for 20 seconds, fixed, washed with water and dried.

The quality of the resulting superimposed letter images was evaluated. A quality of "5" indicates excellent quality (using contact-type light-sensitive material arranged as in FIG. 1, and correctly exposed so that a 50% dot area on the halftone original could be reproduced as a 50% dot area on the light-sensitive material, letter images having a line width of 30 μm could be reproduced on the light-sensitive material). The quality "1" indicates inferior quality (using correct exposure as described above, letter images having a line width of 150 μm or more could barely be reproduced). The quality ranks "4", "3", and "2" were designated between the quality "5" and the quality "1" on a basis of organoleptic test. A quality of "3" or higher incidates that the reproduced image would be practically usable.

The results obtained are shown in Table 3 below. From Table 3, it can be seen that the samples of the present invention provide letter images of good quality.

TABLE 3

| No. | Sample | Redox Compound Type | Redox Compound Amount Added (mol/m²) | Developing Agent Type | Developing Agent Amount Added (mol/m²) | Quality of Superimposed Letter Image |
|---|---|---|---|---|---|---|
| 1 | Comparative Example 12 | — | — | — | — | 3.0 |
| 2 | Comparative Example 13 | Compound 28 | $5.0 \times 10^{-5}$ | — | — | 4.0 |
| 3 | Comparative Example 14 | Compound 38 | $5.0 \times 10^{-5}$ | — | — | 4.5 |
| 4 | Comparative Example 15 | Compound 4 | $7.0 \times 10^{-6}$ | — | — | 4.5 |
| 5 | Comparative Example 16 | Compound 41 | $7.0 \times 10^{-6}$ | — | — | 4.0 |
| 6 | Example 3-1 | Compound 28 | $5.0 \times 10^{-5}$ | Hydroquinone | 100 | 4.5 |
| 7 | Example 3-2 | Compound 38 | $5.0 \times 10^{-5}$ | Hydroquinone | 100 | 5.0 |
| 8 | Example 3-3 | Compound 4 | $7.0 \times 10^{-6}$ | Hydroquinone | 100 | 5.0 |
| 9 | Example 3-4 | Compound 41 | $7.0 \times 10^{-6}$ | Hydroquinone | 100 | 4.5 |

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support;

at least one light-sensitive silver halide emulsion layer containing a hydrazine derivative, on said support;

at least one hydrophilic colloid layer containing a redox compound capable of releasing a development inhibitor upon oxidation, said hydrophilic colloid layer being positioned either above or below said light-sensitive silver halide emulsion layer containing a hydrazine derivative; and a developing agent incorporated, at least, into said at least one light-sensitive silver halide emulsion layer or said at least one hydrophilic colloid layer, wherein said redox compound is a compound represented by formula (I):

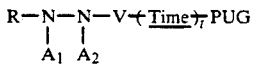

(I)

wherein $A_1$ and $A_2$ each represent a hydrogen atom or one of them represents a hydrogen atom and the other represents a sulfinic acid group or

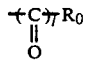

wherein $R_0$ represents an alkyl group, an alkenyl group, an aryl group, an alkoxy group, or an aryloxy group; and l represents 1 or 2;

Time represents a divalent linking group;

t represents 0 or 1;

PUG represents a moiety of a development inhibitor;

V represents a carbonyl group

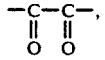

a sulfonyl group,

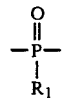

(wherein $R_1$ represents an alkoxy group or an aryloxy group), an iminomethylene group or a thiocarbonyl group; and R represents an aliphatic group, an aromatic group or a heterocyclic group.

2. A silver halide photographic material as claimed in claim 1, wherein said hydrazine derivative is present in an amount of from about $1 \times 10^{-6}$ mol to about $5 \times 10^{-2}$ mol per mol of silver halide.

3. A silver halide photographic material as claimed in claim 1, wherein said developing agent is a dihydroxybenzene, a 1-phenyl-3-pyrazolidone, or an aminophenol.

4. A silver halide photographic material as claimed in claim 1, wherein said developing agent is hydroquinone.

5. A silver halide photographic material as claimed in claim 1, wherein $A_1$ and $A_2$ each represents a hydrogen atom.

6. A silver halide photographic material as claimed in claim 1, wherein the development inhibitor moiety represented by PUG is a group derived from a mercaptotetrazole, a mercaptotriazole, a mercaptoimidazole, a mercaptopyrimidine, a mercaptobenzimidazole, a mercaptobenzothiazole, a mercaptobenzoxazole, a mercaptothiadiazole, a benzotriazole, a benzimidazole, an indazole, an adenine, a guanine, a tetrazole, a tetraazaindene, a triazaindene, or a mercaptoaryl.

7. A silver halide photographic material as claimed in claim 1, wherein said development inhibitor moiety represented by PUG has one or more substituents selected from the group consisting of an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, an alkyloxycarbonyl group, an aryloxycarbonyl group, an acyl group, an alkoxycarbonyl group, an acyloxy group, a carbonamido group, a sulfonamido group, a carboxy group, a sulfoxy group, a phosphono group, a phosphynyl group, and a phosphoramido group.

8. A silver halide photographic material as claimed in claim 1, wherein V represents a carbonyl group.

9. A silver halide photographic material as claimed in claim 1, wherein the amount of said redox compound present is from about $1.0\times10^{-7}$ mol/m$^2$ to about $1.0\times10^{-3}$ mol/m$^2$.

10. A silver halide photographic material s claimed in claim 1, wherein said developing agent is present in an amount of from 0.05 mol to about 5 mol per mol of silver halide.

11. A silver halide photographic material as claimed in claim 1, wherein said hydrazine derivative is represented by formula (II):

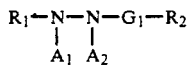

(II)

wherein $R_1$ represents an aliphatic group or an aromatic group;

$R_2$ represents a hydrogen atom, an alkyl group, an aryl group, an alkoxyl group, an aryloxy group, an amino group, a hydrazino group, a carbamoyl group, or an oxycarbonyl group;

$G_1$ represents a carbonyl group, a sulfonyl group, a sulfoxy group, a

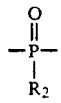

group (wherein $R_2$ is as defined above), a

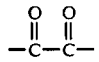

group, a thiocarbonyl group, or an iminomethylene group; and $A_1$ and $A_2$ each represents a hydrogen atom, or one of $A_1$ and $A_2$ represents a hydrogen atom, and the other represents a substituted or unsubstituted alkylsulfonyl group, a substituted or unsubstituted arylsulfonyl group, or a substituted or unsubstituted acyl group.

12. A silver halide photographic material as claimed in claim 11, wherein $R_1$ represents an aryl group.

13. A silver halide photographic material as claimed in claim 11, wherein $G_1$ represents a carbonyl group.

14. A silver halide photographic material as claimed in claim 13, wherein $R_2$ represents a hydrogen atom, an alkyl group, an aralkyl group, or an aryl group.

15. A silver halide photographic material as claimed in claim 11, wherein $R_2$ represents a group represented by formula (a):

$$-R_3-Z_1 \qquad \text{(a)}$$

wherein $Z_1$ represents a group which nucleophilically attacks $G_1$ to split the $G_1$—$R_3$—$Z_1$ moiety from the remainder;

$R_3$ represents a group derived by removing one hydrogen atom from $R_2$; and $R_3$ and $Z_1$ form a cyclic structure together with $G_1$ upon nucleophilic attack of $Z_1$ on $G_1$.

16. A silver halide photographic material as claimed in claim 15, wherein said group represented by general formula (a) is a group represented by formula (b) or (c):

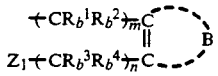

(b)

wherein $Z_1$ is as defined above;

$R_b^1$, $R_b^2$, $R_b^3$, and $R_b^4$, which may be the same or different, each represents a hydrogen atom, an alkyl group, an alkenyl group or an aryl group;

B represents an atomic group necessary to form a substituted or unsubstituted 5-membered or 6-membered ring; and m and n each represents 0 or 1, and (n+m) is 1 or 2;

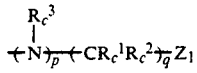

(c)

wherein $Z_1$ is as defined above;

$R_c^1$ and $R_c^2$, which may be the same or different, each represents a hydrogen atom, an alkyl group, an alkenyl group, an aryl group, or a halogen atom;

$R_c^3$ represents a hydrogen atom, an alkyl group, an alkenyl group, or an aryl group;

p represents 0 or 1;

q represents an integer of from 1 to 4; and $R_c^1$, $R_c^2$, and $R_c^3$ may be taken together to form a ring as long as $Z_1$ is capable of intramolecular nucleophilic attack on $G_1$.

17. A silver halide photographic material as claimed in claim 11, wherein $A_1$ and $A_2$ each represents a hydrogen atom.

18. A silver halide photographic material as claimed in claim 11, wherein $R_1$ or $R_2$ contains a group which accelerates adsorption of said hydrazine derivative onto the surface of silver halide grains.

19. A method for forming an image which comprises the steps of:

(a) imagewise exposing to light a silver halide photographic material comprising:

(i) a support;

(ii) at least one light-sensitive silver halide emulsion layer on said support containing a hydrazine derivative;

(iii) at least one hydrophilic colloid layer containing a redox compound capable of releasing a development inhibitor upon oxidation said hydrophilic colloid layer being positioned either above or below said light-sensitive silver halide emulsion layer containing a hydrazine derivative; and (iv) a developing agent incorporated, at least, into said at least one light-sensitive silver halide emulsion layer or said at least on hydrophilic colloid layer wherein said redox compound is a compound represented by formula (I):

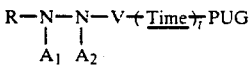

(I)

wherein $A_1$ and $A_2$ each represent atom or one of them represents a hydrogen atom and the other represents a sulfinic acid group or

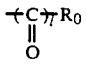

·wherein $R_0$ represents an alkyl group, an alkenyl group, an aryl group, an alkoxy group, or an aryloxy group; and l represents 1 or 2;

Time represents a divalent linking group; p2 t represents 0 or 1;

PUG represents a moiety of a development inhibitor;

V represents a carbonyl group,

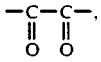

·a sulfonyl group,

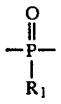

(wherein $R_1$ represents an alkoxy group or an aryloxy group), an iminomethylene group or a thiocarbonyl group; and R represents an aliphatic group, an aromatic group or a heterocyclic group; and (b) developing said exposed material with a developing solution having a sulfite ion concentration of at least about 0.15 mol/l and a pH of from about 10.5 to about 12.3.

20. A method for forming an image as claimed in claim 19, wherein the pH of the developing solution is from about 11.0 to about 12.0.

* * * * *